US010134517B2

(12) United States Patent
Baca

(10) Patent No.: US 10,134,517 B2
(45) Date of Patent: Nov. 20, 2018

(54) SELF-ALIGNING, MULTI-SURFACE MAGNETIC MOUNT FOR ELECTRONIC DISPLAY DEVICES

(71) Applicant: 1LSS, Inc., Canyon County, CA (US)

(72) Inventor: Alejandro Baca, Canyon County, CA (US)

(73) Assignee: 1LSS, Inc.

( * ) Notice: Subject to any disclaimer, the term of this patent is extended or adjusted under 35 U.S.C. 154(b) by 0 days.

(21) Appl. No.: 15/059,163

(22) Filed: Mar. 2, 2016

(65) Prior Publication Data

US 2016/0260532 A1 Sep. 8, 2016

Related U.S. Application Data

(60) Provisional application No. 62/127,238, filed on Mar. 2, 2015.

(51) Int. Cl.
*H01F 7/02* (2006.01)

(52) U.S. Cl.
CPC ..... *H01F 7/0252* (2013.01)

(58) Field of Classification Search
CPC ..... H01F 7/0252
See application file for complete search history.

(56) References Cited

U.S. PATENT DOCUMENTS 2,957,261 A * 10/1960 Moskowitz ..... H01F 7/0252 116/28 R
4,287,676 A 9/1981 Weinhaus
7,431,251 B2 10/2008 Carnevali
7,541,907 B2 * 6/2009 Wang ..... H01F 7/0242 335/214
8,138,868 B2 * 3/2012 Arnold ..... B81C 1/00007 29/729

(Continued)

FOREIGN PATENT DOCUMENTS

FR 2747274 A1 * 10/1997 ..... A45F 5/00
KR 10-2012-0076404 7/2012

(Continued)

OTHER PUBLICATIONS

International Search Report and Written Opinion for International Application No. PCT/US2014/039616, dated Oct. 15, 2014, 16 pages.

*Primary Examiner* — Mohamad Musleh
(74) *Attorney, Agent, or Firm* — Cooley LLP

(57) ABSTRACT

A mounting system for mounting an electronic display device, such as an electronic display device, to various surfaces including nonferrous and nonmagnetic surfaces is provided. In one implementation, the mounting system includes a surface-side attachment affixed to a surface, and a device-side attachment coupled to the electronic display device. The surface-side attachment and the device-side attachment include a plurality of magnets with at least one magnet with an outwardly-facing north pole and at least one magnet with an outwardly-facing south pole per attachment that self-aligns the attachments when mounting the electronic display device to the surface. The surface-side attachment and the device-side attachment may further include mechanical features and/or high friction faces to resist slipping and shear forces when the attachments are coupled together.

19 Claims, 30 Drawing Sheets

(56) References Cited

U.S. PATENT DOCUMENTS

| | | | | |
|---|---|---|---|---|
| 8,138,869 | B1 * | 3/2012 | Lauder | G06F 1/1613 24/303 |
| 8,214,002 | B2 * | 7/2012 | Noma | H01F 7/0252 335/285 |
| 8,242,868 | B2 | 8/2012 | Lauder et al. | |
| 8,531,827 | B2 * | 9/2013 | Huang | G06F 1/1613 361/679.26 |
| 2006/0091986 | A1 * | 5/2006 | Coleman, Jr. | B25B 11/002 335/285 |
| 2009/0278642 | A1 * | 11/2009 | Fullerton | G01D 18/00 335/284 |
| 2012/0188034 | A1 * | 7/2012 | Ku | H01F 7/0252 335/219 |
| 2014/0205851 | A1 * | 7/2014 | Mahajan | B32B 7/12 428/554 |
| 2014/0347795 | A1 | 11/2014 | Baca | |

FOREIGN PATENT DOCUMENTS

| | | |
|---|---|---|
| KR | 10-2013-0041377 | 4/2013 |
| WO | WO 2014/193853 | 12/2014 |

* cited by examiner

FIG. 4A

| | | | | |
|---|---|---|---|---|
| N | S | N | S | N |
| N | S | N | S | N |

FIG. 4B

| | | | | |
|---|---|---|---|---|
| N | S | N | S | N |
| S | N | S | N | S |

FIG. 4C

| | | | | |
|---|---|---|---|---|
| N | N | S | N | N |
| S | S | N | S | S |

FIG. 4D

| | | | | |
|---|---|---|---|---|
| S | N | S | N | S |
| S | S | N | S | S |

FIG. 4E

| | | | |
|---|---|---|---|
| S | N | S | N |

FIG. 4F

| | | | |
|---|---|---|---|
| S | N | N | S |

FIG. 4G

| | | | |
|---|---|---|---|
| S | N | S | N |

FIG. 4H

| | | |
|---|---|---|
| S | N | S |

FIG. 4I

| | |
|---|---|
| S | N |

FIG. 4J

| | | | | |
|---|---|---|---|---|
| N | S | Fe | N | S |

FIG. 4K

| | | | |
|---|---|---|---|
| Fe | N | S | Fe |

FIG. 4L

| | | |
|---|---|---|
| S | Fe | N |

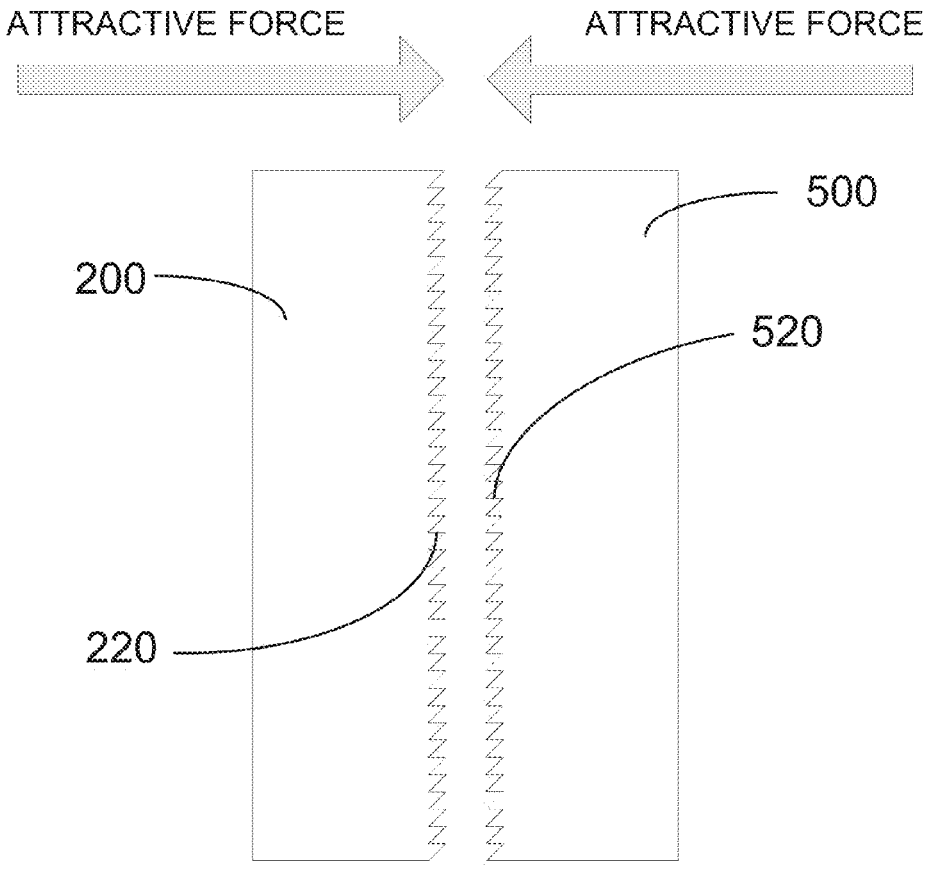
FIG. 6
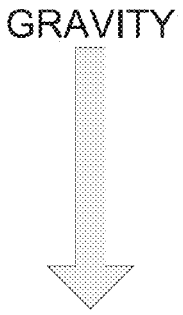

SELF-ALIGNING, MULTI-SURFACE MAGNETIC MOUNT FOR ELECTRONIC DISPLAY DEVICES

CROSS REFERENCES TO RELATED APPLICATIONS

This application claims priority under 35 U.S.C. § 119(e) to and the benefit of U.S. Provisional Patent Application Ser. No. 62/127,238, filed Mar. 2, 2016, entitled "SELF-ALIGNING, MULTI-SURFACE MAGNETIC MOUNTING SYSTEM FOR ELECTRONIC DISPLAY DEVICES," which is hereby incorporated by reference in its entirety for all purposes.

This application is related to U.S. patent application Ser. No. 14/288,243, entitled "Low Profile Magnetic Mount for Electronic Display Devices," filed May 27, 2014, the disclosure of which is incorporated herein by reference in its entirety for all purposes.

FIELD

The embodiments described herein relate generally to the field of electronic display device mounts, and more specifically, to a mounting system that can be used to easily mount and unmount electronic display devices to various surfaces. In particular, the embodiments described herein are suitable for rapidly mounting and unmounting electronic display devices to various surfaces, including nonferrous and nonmagnetic surfaces.

BACKGROUND

There are many known mounting systems for various electronic display devices. These electronic display devices include, but are not limited to tablet computers, smartphones, televisions, and LCD displays. As technology progresses, these devices are becoming thinner and lighter. Along with this, the importance for low profile, temporary mounting mechanisms has become more valuable. Current mounting mechanisms can be cumbersome, bulky, and can add considerable weight to the electronic display device. These mounting mechanisms often require adjustment and readjustment of the electronic display device after mounting as it can be difficult to align the electronic display device in the desired position. Also, with current mounting mechanisms, in can be difficult to unmount the electronic display device. Current mounting mechanisms do not allow for rapidly repositioning the electronic display device from portrait to landscape orientations.

Thus, a need exists to provide a self-aligning mounting system for rapidly mounting and unmounting electronic display devices to a variety of different types of mounting surfaces without adding significant bulk to the electronic display device or to the mounting surface. A need also exists for a self-aligning mounting system that allows for electronic display devices to be quickly reoriented from portrait to landscape orientations.

SUMMARY

The disclosure generally relates to a self-aligning, mounting system for mounting an electronic display device, such as an electronic display device, to various surfaces, including non-ferrous surfaces. The mounting system includes a device-side attachment coupled to the electronic display device. In one implementation, a plurality of magnets is embedded within the device-side attachment. Alternatively, a plurality of magnets may be attached to the electronic display device that is covered by a protective housing. In another implementation, the device-side attachment is integrated into the electronic display device during its manufacture.

The mounting system further includes a surface-side attachment affixed to a surface including a nonmagnetic surface. While it is recognized that the surface-side attachment can be affixed to a ferromagnetic surface, the present mounting system is especially suitable for nonmagnetic surfaces. In one implementation, a plurality of magnets is embedded within the surface-side attachment. Alternatively, a plurality of magnets may be directly attached to the nonmagnetic surface that is covered by a protective housing. In another implementation, the surface-side attachment is integrated into the nonmagnetic surface during its manufacture.

The device-side attachment coupled to the electronic display device self-aligns with the surface-side attachment affixed to a surface to rapidly and precisely position the electronic display device during mounting. It is also a feature of the disclosed mounting device that a user may easily rapidly dismount the electronic display device from a surface to which it had been mounted. Moreover, the mounting system advantageously does not add significant thickness or weight to the electronic display device or the mounting surface.

The mounting system may include a plurality of magnets to couple to an electronic display device. The mounting system may further include a plurality of magnets to attach to a surface. The magnets used in the mounting system may include a high friction finish covering the outer surface that resists slipping and shear forces when the magnets are coupled.

In another aspect the disclosure relates to a mounting system that includes a plurality of magnets coupled to an electronic display device. The mounting system may further include a plurality of magnets attached to a surface. The magnets used in the mounting system may include a mechanical feature on the outer surface that resists slipping and the force of gravity when the magnets are coupled.

In one implementation, a mounting system for mounting an electronic display device to a surface includes a device-side attachment containing a first plurality of magnets disposed and configured to couple to the electronic display device. The first plurality of magnets includes at least one magnet with an outwardly-facing north pole and at least one magnet with an outwardly-facing south pole. The mounting system also includes surface-side attachment containing a second plurality of magnets disposed and configured to couple to the surface. The second plurality of magnets includes at least one magnet with an outwardly-facing north pole and at least one magnet with an outwardly-facing south pole. The at least one outwardly-facing north pole of the first plurality of magnets is arranged to couple with the at least one outwardly-facing south pole of the second plurality of magnets. The at least one outwardly-facing south pole of the first plurality of magnets is arranged to couple with the at least one outwardly-facing north pole of the second plurality of magnets.

In one implementation, a self-aligning mounting system for mounting an electronic display device to a surface includes a device-side attachment containing a first plurality of magnets disposed in a protective cover for the electronic display device. The first plurality of magnets includes at least one magnet with an outwardly-facing north pole of a magnet and at least one magnet with an outwardly-facing south pole. The protective cover can include a high friction surface covering the first plurality of magnets. The mounting system also includes a surface-side attachment that includes a second plurality of magnets disposed in a housing and configured to attach to the surface. The second plurality of magnets includes at least one magnet with an outwardly-facing north pole and at least one magnet with an outwardly-facing south pole. The at least one outwardly-facing north pole of the first plurality of magnets is arranged to attractively couple with the at least one outwardly-facing south pole of the second plurality of magnets. The at least one outwardly-facing south pole of the first plurality of magnets is arranged to couple with the at least one outwardly-facing north pole of the second plurality of magnets. The high friction surface covering the first plurality of magnets is configured to be disposed between the first plurality of magnets when coupled to the second plurality of magnets.

In one implementation, a mounting system for mounting an electronic display device to a surface includes a device-side attachment having a first outward face and a first plurality of magnets disposed and configured to couple to the electronic display device. The first plurality of magnets includes at least one magnet with an outwardly-facing north pole of a magnet and at least one magnet with an outwardly-facing south pole. The first outward face includes at least one recess and/or at least one protrusion. The mounting system also includes a surface-side attachment that includes second outward face and a second plurality of magnets disposed and configured to attach to the surface. The second plurality of magnets includes at least one magnet with an outwardly-facing north pole of a magnet and at least one magnet with an outwardly-facing south pole. The second outward face includes at least one recess and/or at least one protrusion. The at least one outwardly-facing north pole of the first plurality of magnets is arranged to attractively couple with the at least one outwardly-facing south pole of the second plurality of magnets. The at least one outwardly-facing south pole of the first plurality of magnets is arranged to attractively couple with the at least one outwardly-facing north pole of the second plurality of magnets. The first outward face of the device-side attachment is configured to mechanically interfere with the second outward face of the surface-side attachment to inhibit a shear force.

In one implementation, a mounting system for mounting an electronic display device to a surface includes a protective case defining an interior surface conforming to an exterior surface of an electronic display device. A first plurality of magnets contacts the protective case and configured to couple to the electronic display device. The first plurality of magnets including at least one magnet with an outwardly-facing north pole and at least one magnet with an outwardly-facing south pole. The at least one magnet with an outwardly-facing north pole of the first plurality of magnets is arranged to couple with at least one magnet with an outwardly-facing south pole of a second plurality of magnets included within a surface-side attachment attached to the surface. The at least one magnet with an outwardly-facing south pole of the first plurality of magnets is arranged to couple with at least one magnet with an outwardly-facing north pole of the second plurality of magnets.

The device-side attachment may further comprise a first adhesive to couple the first plurality of magnets to the electronic display device. The first adhesive can be a pressure sensitive adhesive. The surface-side attachment may further comprise a second adhesive to couple the surface-side attachment to the surface. The second adhesive can be a pressure sensitive adhesive.

The first plurality of magnets and the second plurality magnets may be made from rare earth metals. The rare earth metals may include alloys of neodymium or samarium-cobalt. The first plurality of magnets and the second plurality magnets can be grade N48 or higher. The first plurality of magnets and the second plurality magnets may each comprise two linear rows of magnets.

The surface-side attachment and the device-side attachment may be made from one or both of a metal and a polymer. The housing can be made from one or both of a metal and a polymer. The second plurality of magnets may be glued to the housing. The first plurality of magnets may be glued to the device-side attachment and the second plurality of magnets may be glued to the surface-side attachment.

The first plurality of magnets may be affixed to the interior of the protective cover. The first plurality of magnets may be embedded in the protective cover or the protective case. The first plurality of magnets is affixed to an exterior surface of the protective cover or the protective case. The protective cover may include a high friction surface covering the first plurality of magnets.

The shear force between the surface-side attachment and the device-side attachment may be in a direction substantially parallel to the first outward face and parallel to the second outward face. The shear force may be a direction perpendicular to an attractive force between the first plurality of magnets and the second plurality of magnets.

The device-side attachment may include at least one recess and the surface-side attachment includes at least one protrusion The at least one recess mechanically interferes with the at least one protrusion. Alternatively, the surface-side attachment may include the at least one recess and the device-side attachment may include at least one protrusion. The at least one recess mechanically interferes with the at least one protrusion. The first plurality of magnets may include a first outward face and the second plurality of magnets may include a second outward face. The first outward face may include a first mechanical anti-slip feature and the second outward face may include a second mechanical anti-slip feature. The first mechanical anti-slip feature is a protrusion and the second mechanical anti-slip feature is a recess. The first mechanical anti-slip feature may be a saw tooth pattern and the second mechanical anti-slip feature may be a complementary saw tooth pattern. The first mechanical anti-slip feature may be a continuous sinusoidal wave pattern and the second mechanical anti-slip feature may be a complementary continuous sinusoidal wave pattern. The first mechanical anti-slip feature may be a first roughened outward face and the second mechanical anti-slip feature may be a second roughened outward face. The first roughened outward face and the second roughened outward face may have an average surface roughness of between 100 and 300 microns RMS.

BRIEF DESCRIPTION OF THE DRAWINGS

FIGS. 4A to 4I depict examples of self-aligning arrangements of magnets for device-side attachments and for surface-side attachments.

FIGS. 4J to 4L depict examples of self-aligning arrangements of magnets for device-side attachments and for surface-side attachments including ferrous inserts.

FIG. 6 is a profile view of magnets with mechanical anti-slip features, according to another embodiment.

DETAILED DESCRIPTION

Figure 1A:
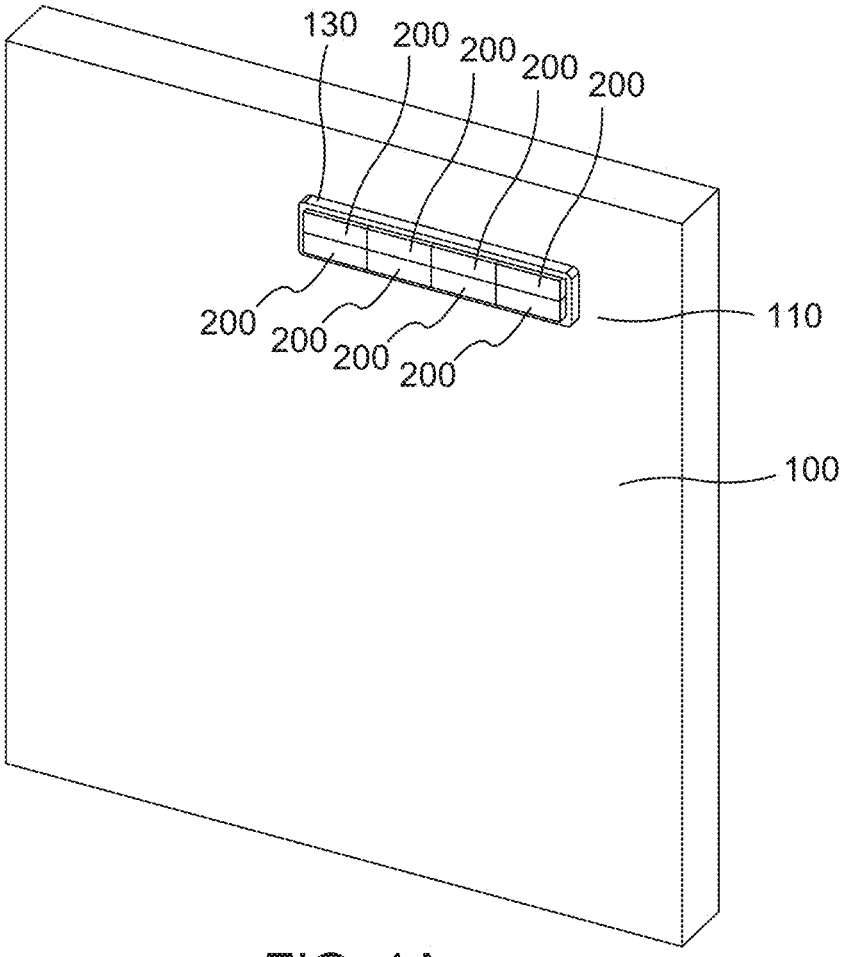
FIG. 1A is a perspective view of a surface-side attachment affixed to a surface, according to an embodiment.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of" or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

As used herein in the specification and in the claims, an "electronic display device" should be understood to mean any electronic device or any display device including cell phones, computer tablets, phablets, electronic organizers, personal digital assistant, navigation devices (GPS), radar detectors, garage door openers, remote controls, wireless microphones and/or speakers, cameras, video recorders, music players, controllers and microcomputers. While the mounting system described herein is intended for electronic display devices, it should be understood that the mounting system is suitable for any object of similar size and dimensions as an electronic display device.

As used herein in the specification and in the claims, "outward" or "outwardly," should be understood to mean facing away from of an object or surface, rather than facing toward an object or surface to which it is affixed. For example, magents 200 of the surface-side attachment 110 affixed to a surface 100 have an outward face that farthest away from the surface 100. The outward faces of the attachments are designed to couple to each other and can have complementary physical features which interact with each other. When the device-side attachment is mounted to the surface-side attachment, the outward face of the surface-side attachment is coupled to the outward face of device-side attachment.

A system for mounting an electronic display device to various surfaces is described herein. In some embodiments, the mounting system includes a device-side attachment containing a plurality of magnets coupled to an electronic display device. In some embodiments, a plurality of magnets is embedded within a housing of a device-side attachment. In some embodiments, a plurality of magnets may be directly attached to an electronic display device that is covered by a protective housing. In some embodiments, a plurality of magnets is integrated into a protective case for an electronic display device. In some embodiments, the device-side attachment is integrated into the electronic display device during its manufacture.

The mounting system further includes a surface-side attachment affixed to a surface. In some embodiments, a plurality of magnets is embedded within a housing of the surface-side attachment. In some embodiments, a plurality of magnets may be directly attached to a surface or embedded subsurface. In some embodiments, the surface-side attachment may be integrated into a surface during its manufacture.

The mounting system permits a user to easily dismount the electronic display device from a mounting surface. The system can also permit a user to mount and dismount a single device-side attachment with multiple surface-side attachments affixed in different locations. For example, a device-side attachment affixed to an electronic display device can be dismounted from a first surface-side attachment in a first location, and then mounted to a second surface-side attachment in a second location. In this manner, a device-side attachment can be compatible with a multitude of surface-side attachments.

The mounting system can also permit a user to mount and to dismount multiple device-side attachments with a single surface-side attachment. For example, a first device-side attachment affixed to a first electronic display device can be dismounted from a surface-side attachment, and then a second device-side attachment affixed to a second electronic display device can be mounted to the same surface-side attachment. In this manner, a multitude of device-side attachments can be compatible with a surface-side attachment.

In some embodiments, a single device-side attachment having a plurality of magnets proximate to one another can be attached to an electronic display device. In the same embodiments, a single surface-side attachment having a plurality of magnets proximate to one another can be attached to a surface. This embodiment of a mounting system has cost and ease of use advantages by having only two pieces; i.e. a device-side attachment and a surface-side attachment. A user only has to position and attach the two pieces to mount the electronic display device. Unlike mounting systems which may require aligning multiple device-side attachments with respect to each other and aligning the multiple device-side attachments with respect to multiple surface-side attachments, having a single device-side attachment couplable to a single surface-side attachment provides quick and easy installation of the mounting system.

A mounting system as described herein can be added to an electronic display device without adding significant thickness or weight to the electronic display device or to the mounting surface. Unlike a mounting mechanism that only includes covered magnets affixed to an electronic display device and that is only suitable for attaching to ferromagnetic surfaces, the device-side attachment of the present mounting system can provide equal coupling strength but with a lesser overall thickness. This is because to the magnet-magnet attractive forces of both the device-side attachment and the surface-side attachment can provide greater attractive force than a single covered magnet attracted to a ferrous surface.

Figure 1B:
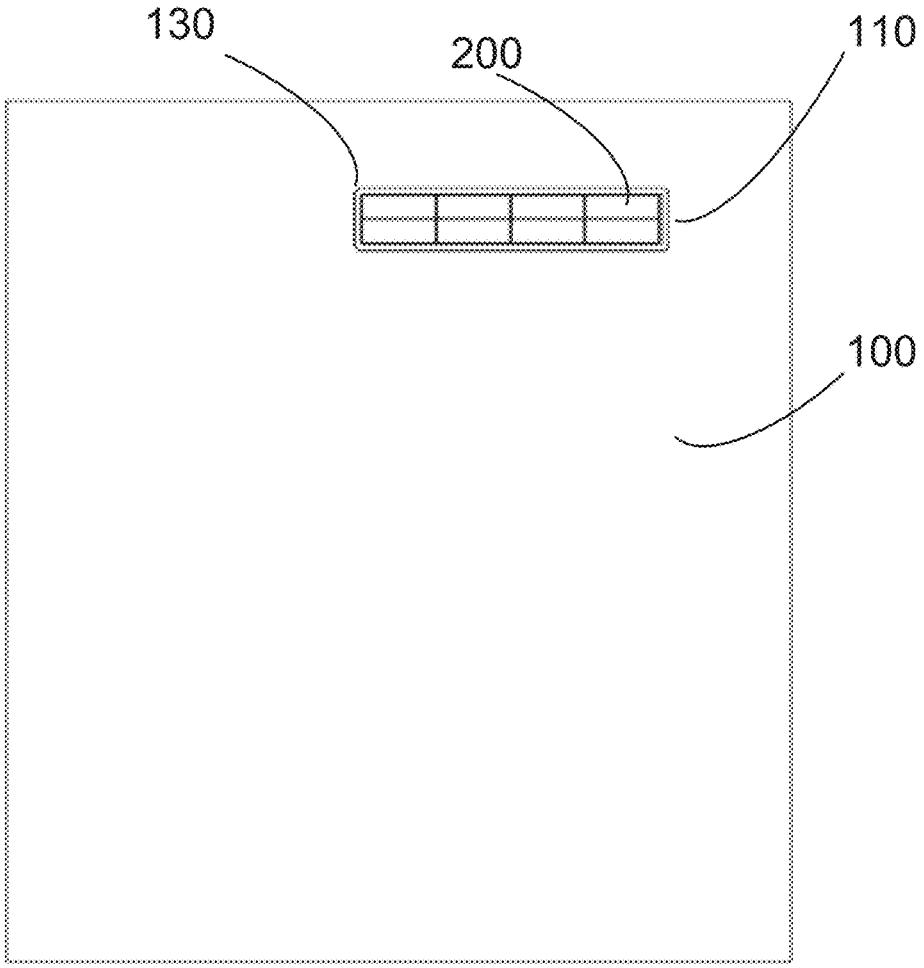
FIG. 1B is a front view of a surface-side attachment affixed to a surface, according to an embodiment.
Figure 1C:
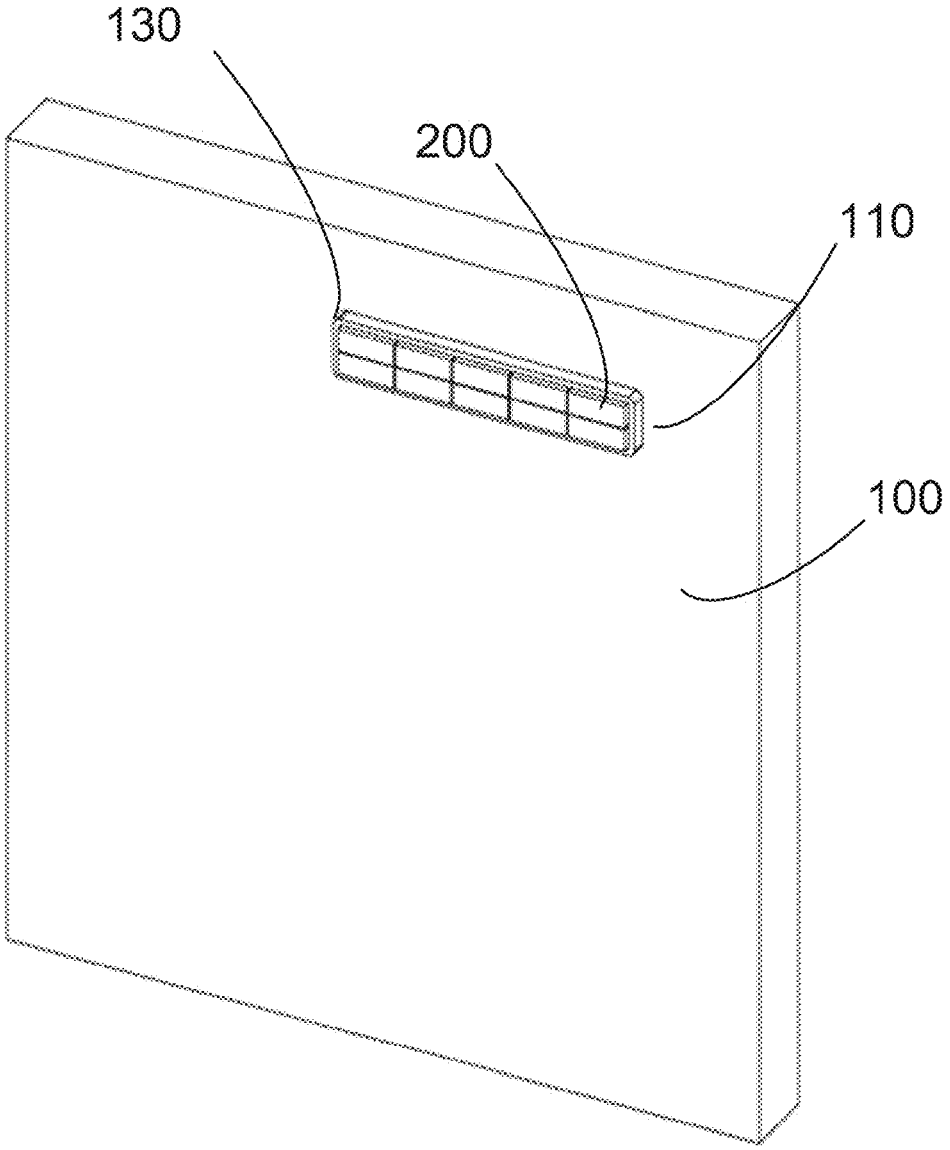
FIG. 1C is a perspective view of a surface-side attachment affixed to a surface, according to another embodiment.
Figure 1D:
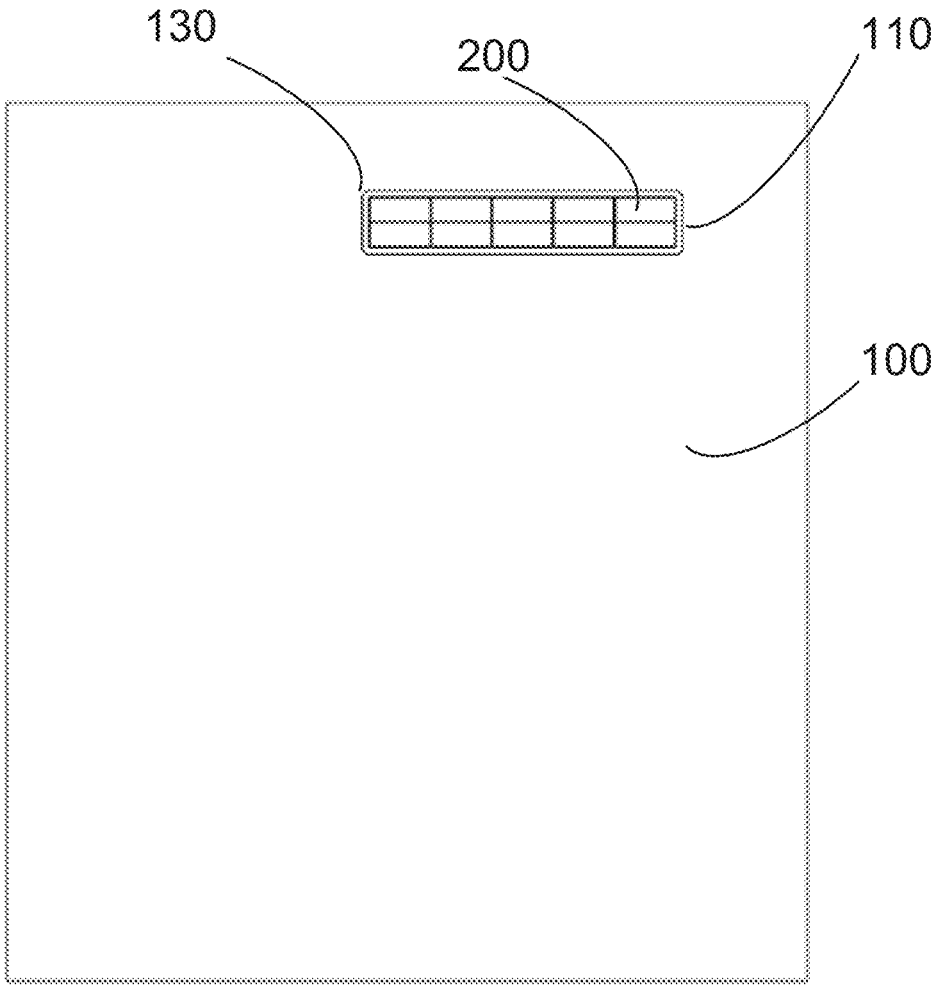
FIG. 1D is a front view of a surface-side attachment affixed to a surface, according to another embodiment.
Figure 1E:
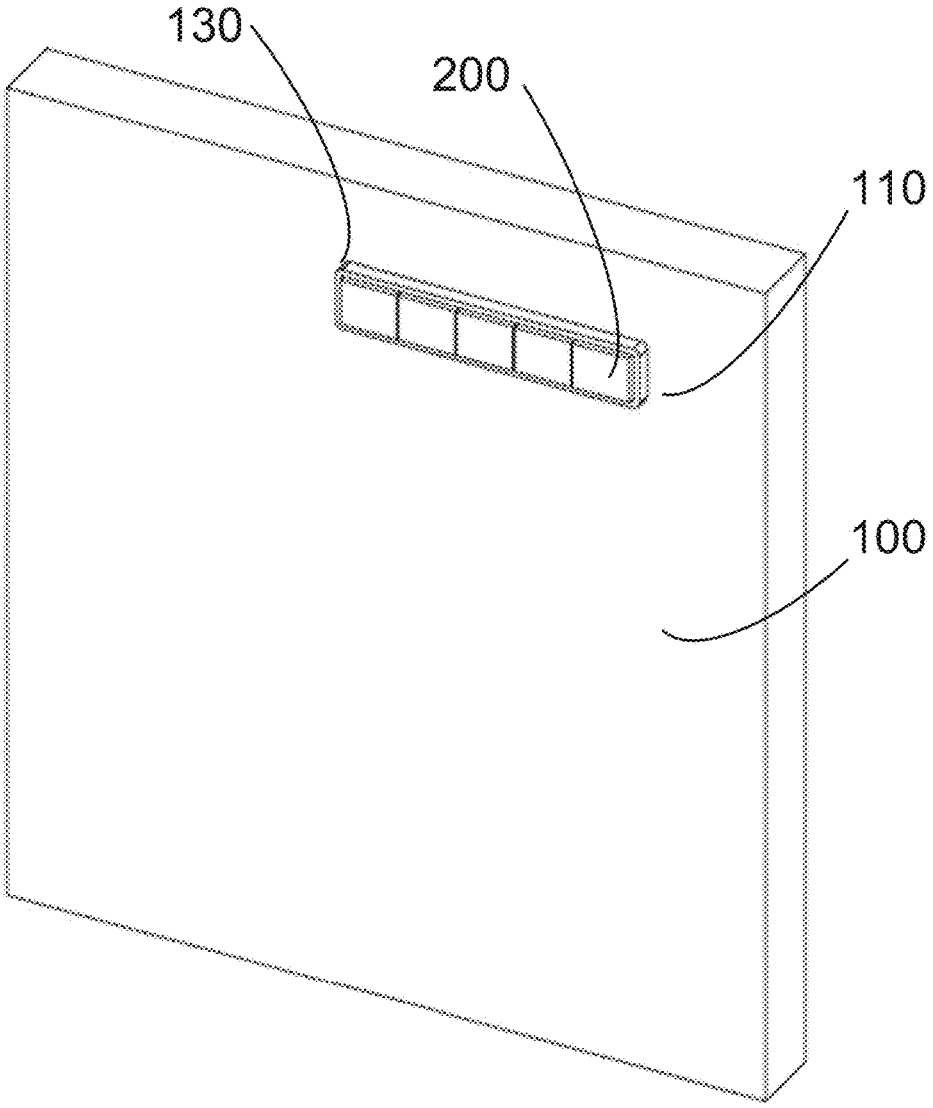
FIG. 1E is a perspective view a surface-side attachment affixed to a surface, according to another embodiment.
Figure 1F:
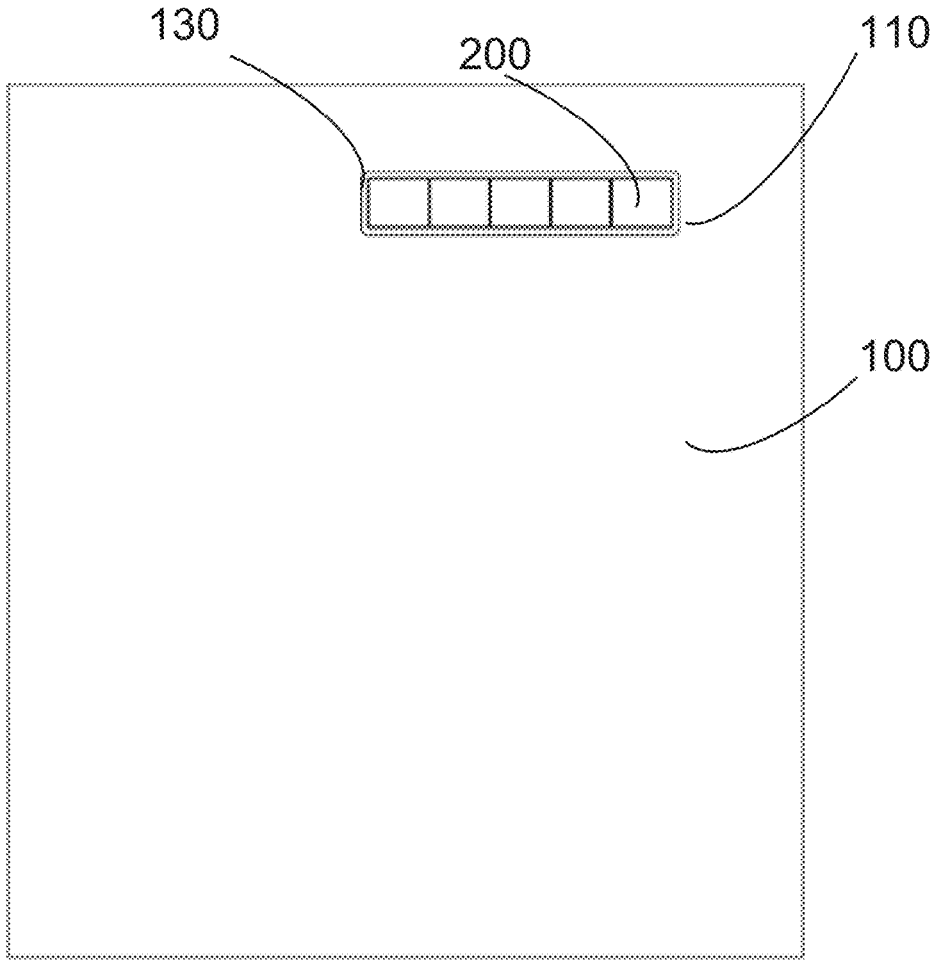
FIG. 1F is a front view of a surface-side attachment affixed to a surface, according to another embodiment.

FIGS. 1A, 1C, and 1E are perspective views of a surface 100 with a surface-side attachment 110 according to an embodiment, and FIGS. 1B, 1D, and 1F show front views of the surface-side attachment 110. Surface-side attachment 110 can include a surface-side attachment housing 130 containing a plurality of magnets 200. As shown in FIGS. 1A and 1B, the surface-side attachment 110 can include two linear rows, with each linear row containing four individual magnets 200. As shown in FIGS. 1C and 1D, the surface-side attachment 110 can include two linear rows, with each linear row containing five individual magnets 200. As shown in FIGS. 1E and 1F, the surface-side attachment 110 can include a single linear row containing five individual magnets 200. It should be recognized that any number of magnets greater than two can be used in surface-side attachment 110, and that FIGS. 1A to 1F are merely exemplary embodiments.

Surface-side attachment housing 130 is preferably made out of a metal such as aluminum, or alternately, it can be made out of polymer or a combination of metal and polymer. Magnets 200 can be permanently bonded to the surface-side attachment housing 130 using adhesive or mechanical fasteners. In one embodiment, the edges of surface-side attachment housing 130 are crimped to retain magnets 200.

The surface-side attachment 110 refers to a plurality of magnets 200 couplable to a surface. Surface-side attachment 110 can be affixed to surface 100 with adhesive or by using a mechanical fastener. For example, double-sided adhesive tape can be used to permanently or temporarily affix surface-side attachment 110 to surface 100. Alternatively, adhesive glue can be selected based on the surface 100 characteristics and desired bond characteristics to affix surface-side attachment 110 to surface 100. In one example, the surface-side attachment 110 is affixed to the dash of an automobile using double-sided adhesive tape. In another example, the surface-side attachment 110 is affixed to the bezel of a computer monitor using double-sided adhesive tape.

Figure 17:
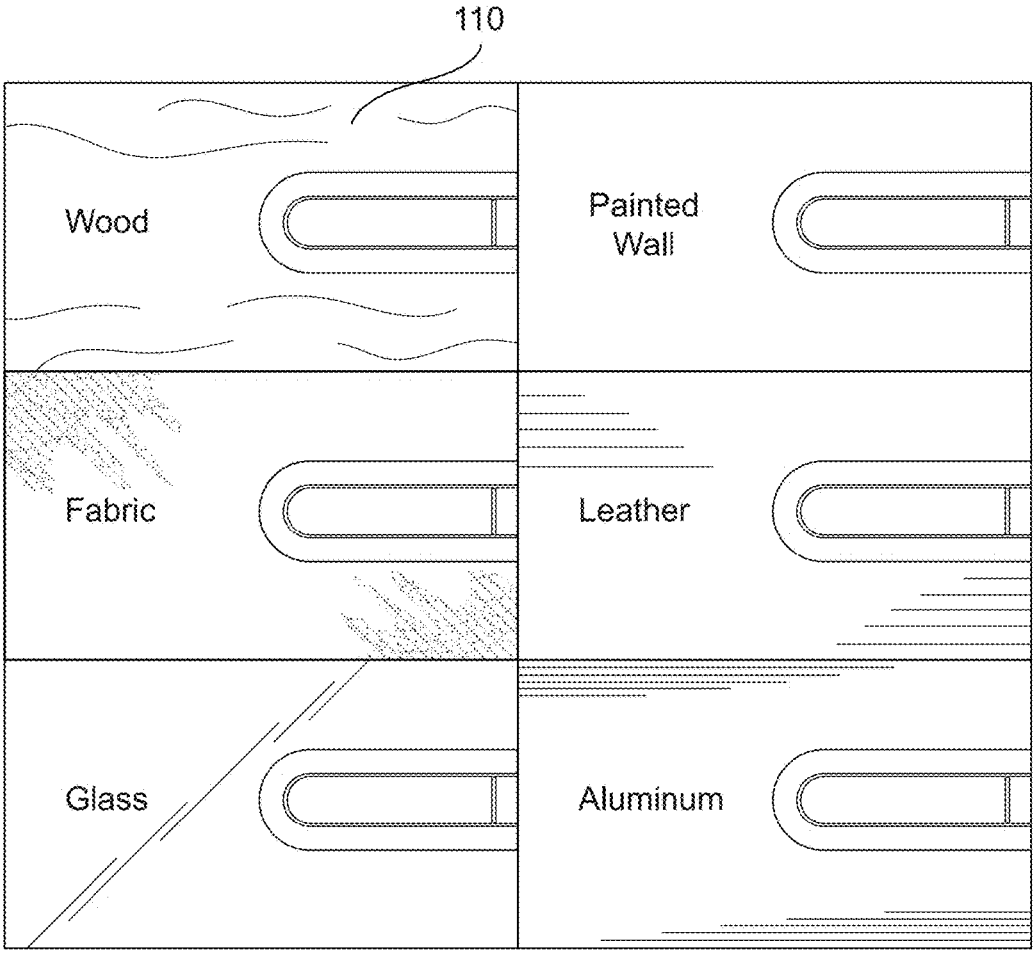
FIG. 17 shows partial front views of a surface-side attachment affixed to various surfaces.

Surface 100 can be any solid surface including nonmagnetic surfaces and nonferrous surfaces. For example, surface 100 can be polymer, wood, glass, metal and combinations thereof. Generally, nonporous surfaces provide for greater adhesion of the surface-side attachment 110, though surface-side attachment 110 can be bonded to porous surfaces by using a suitable adhesive or mechanical fastener. FIG. 17 shows partial front view of surface-side attachment 110 attached to various surfaces.

Figure 2A:
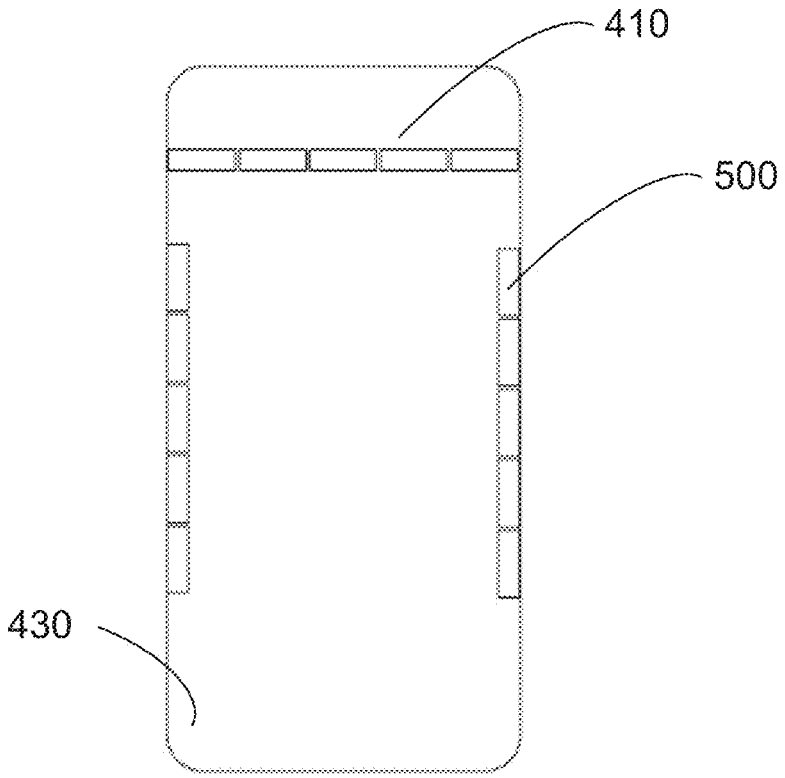
FIGS. 2A and 2B are front views of multiple device-side attachments embedded within the interior of a protective case for an electronic display device, according to an embodiment.
Figure 2B:
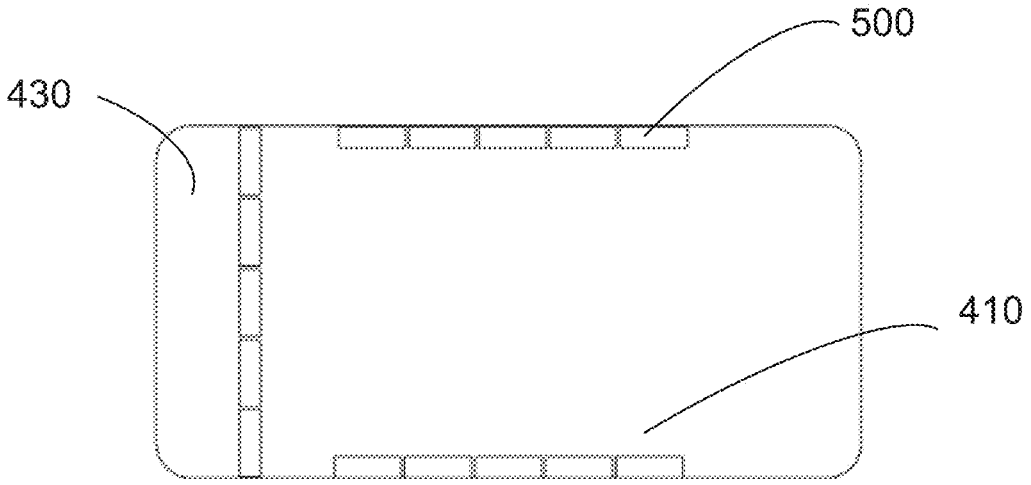
Figure 2C:
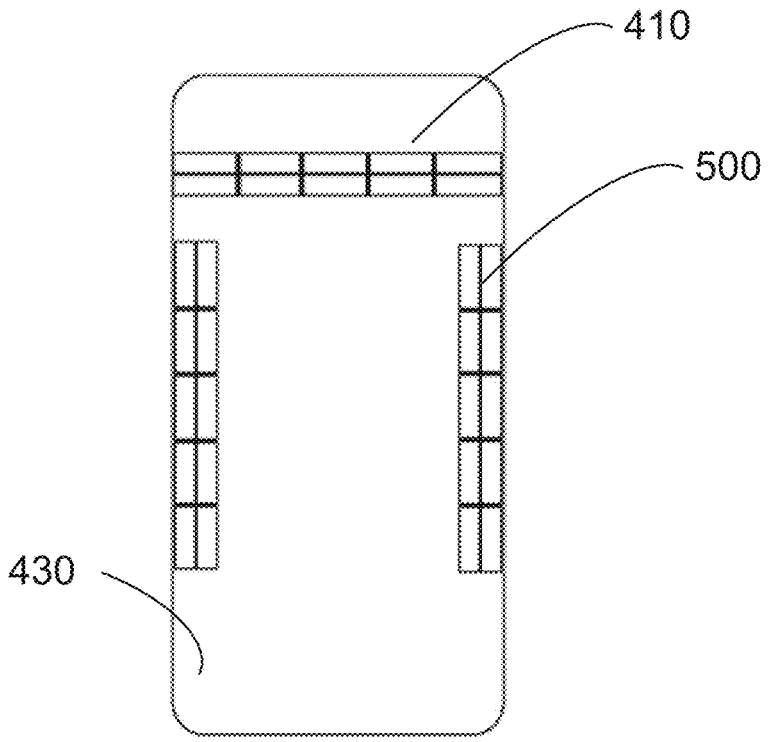
FIGS. 2C and 2D are front views of multiple device-side attachments embedded within the interior of a protective case for an electronic display device, according to another embodiment.
Figure 2D:
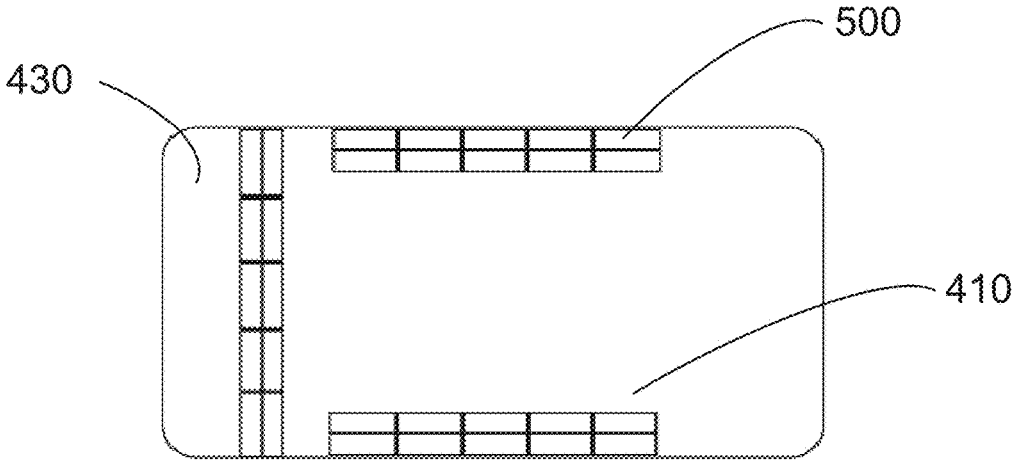

FIGS. 2A to 2D are front views of multiple device-side attachments 410 embedded in the interior of a protective case 430 for an electronic display device, according to an embodiment. The device-side attachments 410 are embedded in the perimeter of the protective case 430 to allow the electronic display device to be hung in either a portrait orientation, as shown in FIG. 2A, or a landscape orientation, as shown in FIG. 2B. As shown in FIGS. 2A and 2B, the device-side attachments 410 can include a single linear row containing five individual magnets 500. As shown in FIGS. 2C and 2D, the device-side attachment 410 can include two linear rows, with each linear row containing five individual magnets 500. It should be recognized that any number of magnets greater than two can be used in device-side attachment 410, and that FIGS. 2A to 2D are merely exemplary embodiments. The device-side attachment 410 refers to a plurality of magnets 500 couplable to an electronic display device.

Protective case 430 is preferably made out of a polymer, or alternately, it can be made out of metal, cellulosic material, and combinations thereof. Device-side attachment 410 can be permanently embedded within protective case 430 or bonded to the protective case 430 using an adhesive. Mechanical fasteners can also be used to secure device-side attachment 410 to the protective case 430, are especially suitable for applications with require a high strength connection.

Figure 3A:
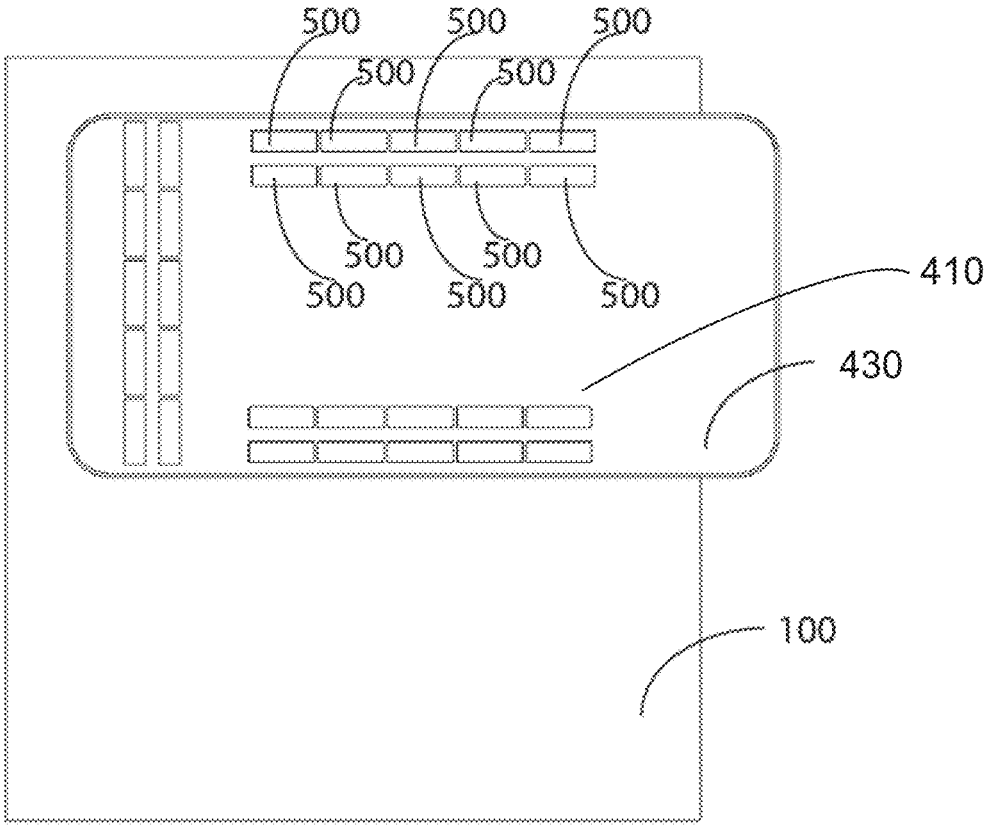
FIG. 3A is a front view of multiple device-side attachments affixed to the interior of a protective case for an electronic display device that is mounted in a landscape orientation to a surface, according to an embodiment.
Figure 3B:
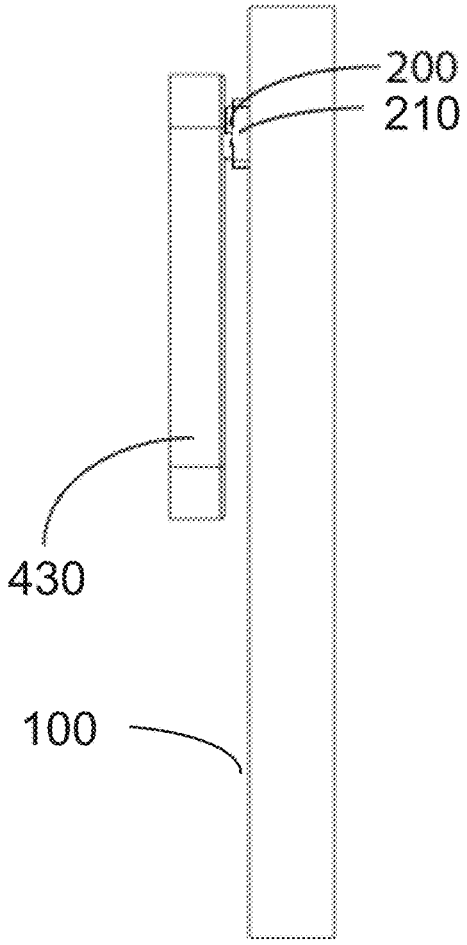
FIG. 3B is a profile view of multiple device-side attachments affixed to the interior of a protective case for an electronic display device that is mounted in a landscape orientation to a surface, according to an embodiment.
Figure 3C:
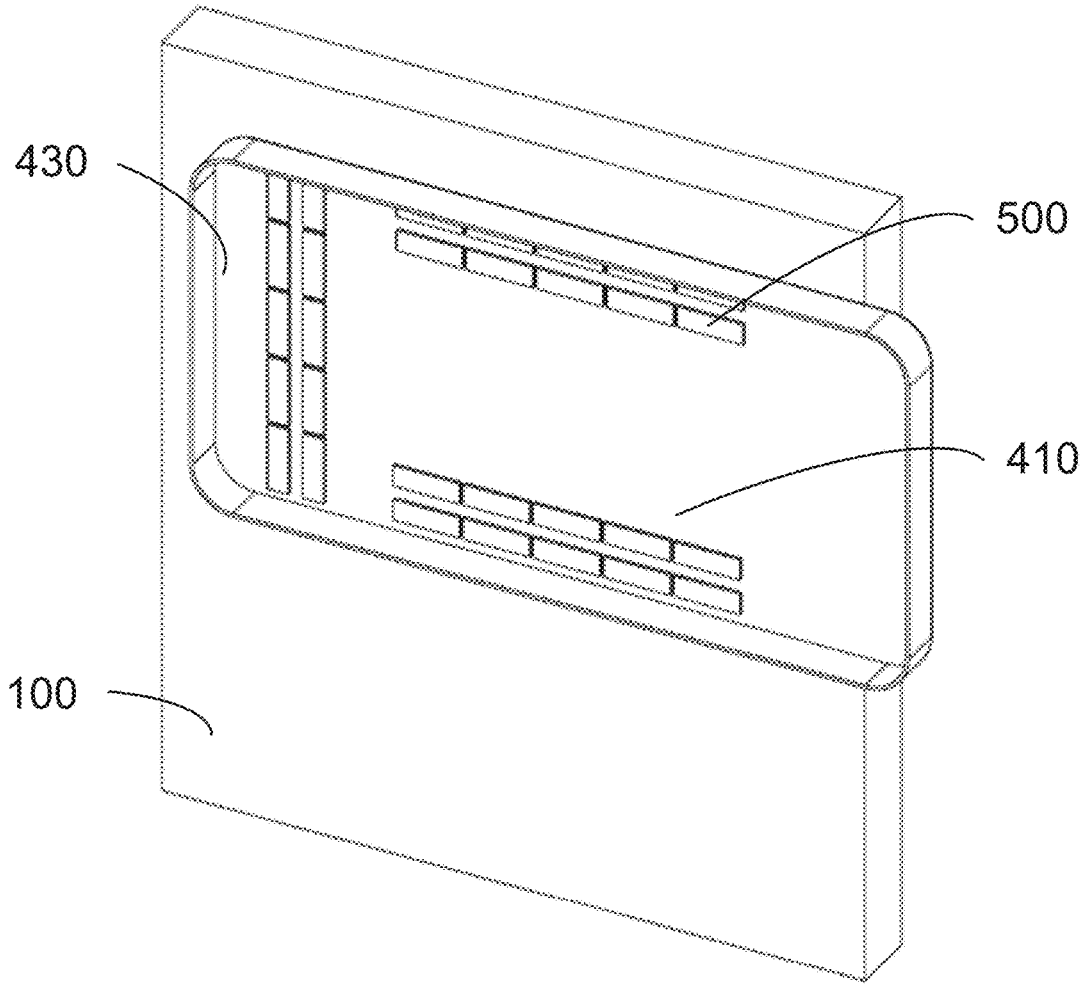
FIG. 3C is a perspective view of multiple device-side attachments affixed to the interior of a protective case for an electronic display device that is mounted in a landscape orientation to a surface, according to an embodiment.
Figure 3D:
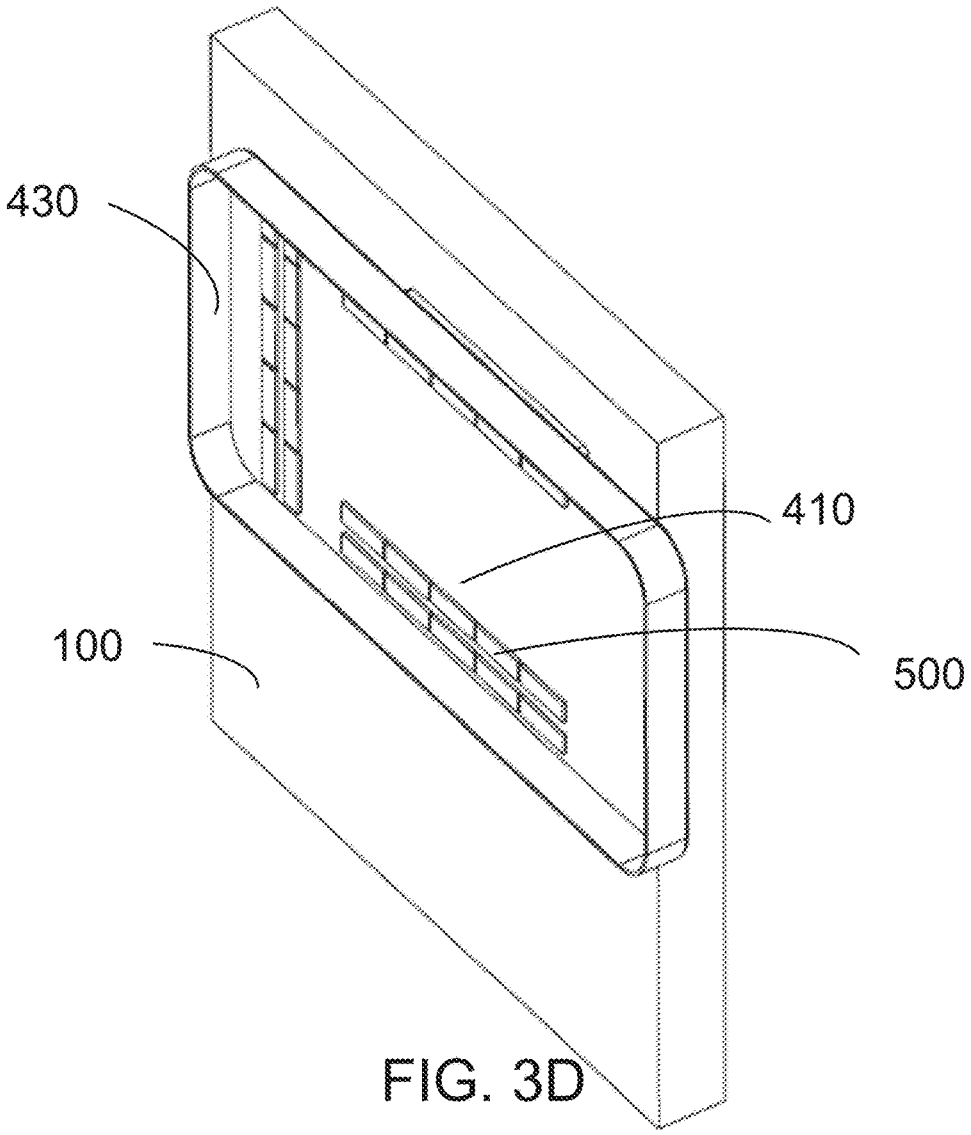
FIG. 3D is another perspective view of multiple device-side attachments affixed to the interior of a protective case for an electronic display device that is mounted in a landscape orientation to a surface, according to an embodiment.

FIGS. 3A to 3D show multiple views of an embodiment of a protective case 430 mounted in a landscape orientation. FIG. 3A is a front view of multiple device-side attachments 410 attached to the interior of a protective case 430 for an electronic display device that is mounted to a surface 100. FIG. 3B is a profile view of multiple device-side attachments 410 affixed to the interior of a protective case 430 for an electronic display device that is mounted to a surface 100. FIG. 3C is a perspective view of multiple device-side attachments 410 affixed to the interior of a protective case 430 for an electronic display device that is mounted to a surface 100. FIG. 3D is another perspective view of multiple device-side attachments 410 affixed to the interior of a protective case 430 for an electronic display device that is mounted to a surface 100.

Figure 3E:
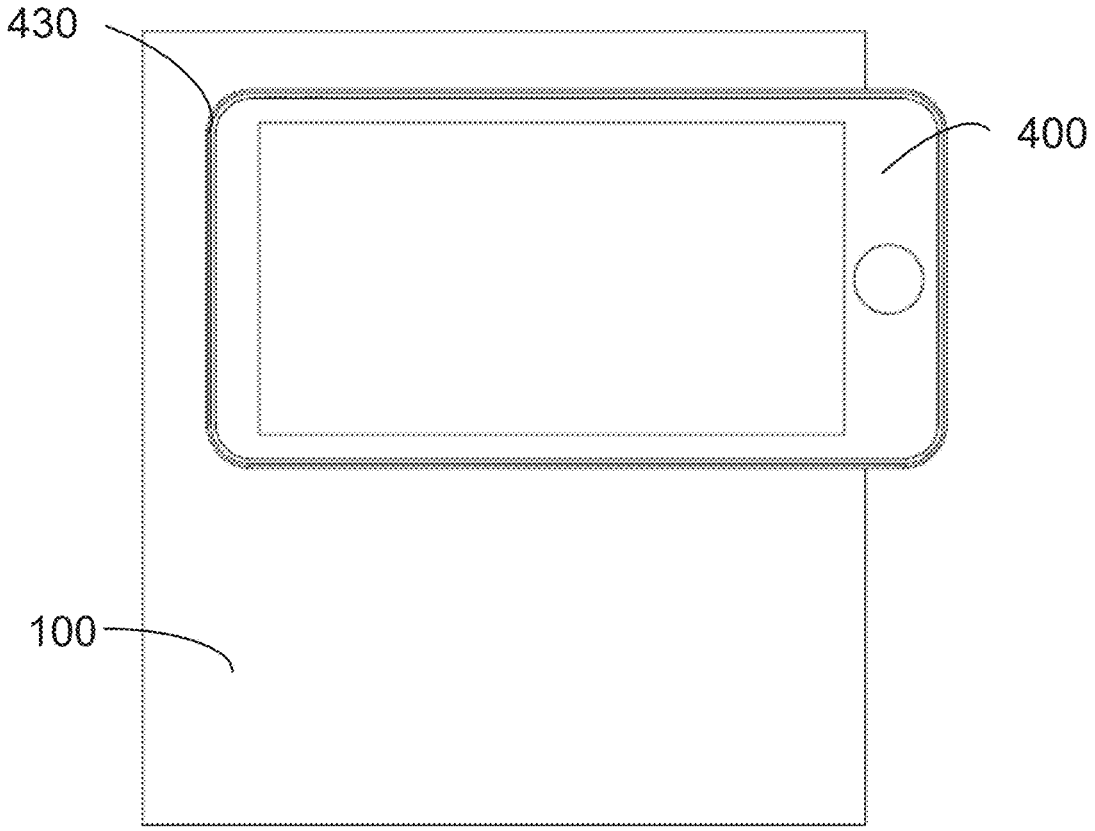
FIG. 3E is a front view of an electronic display device within a protective case that is mounted to a surface, according to an embodiment.
Figure 3F:
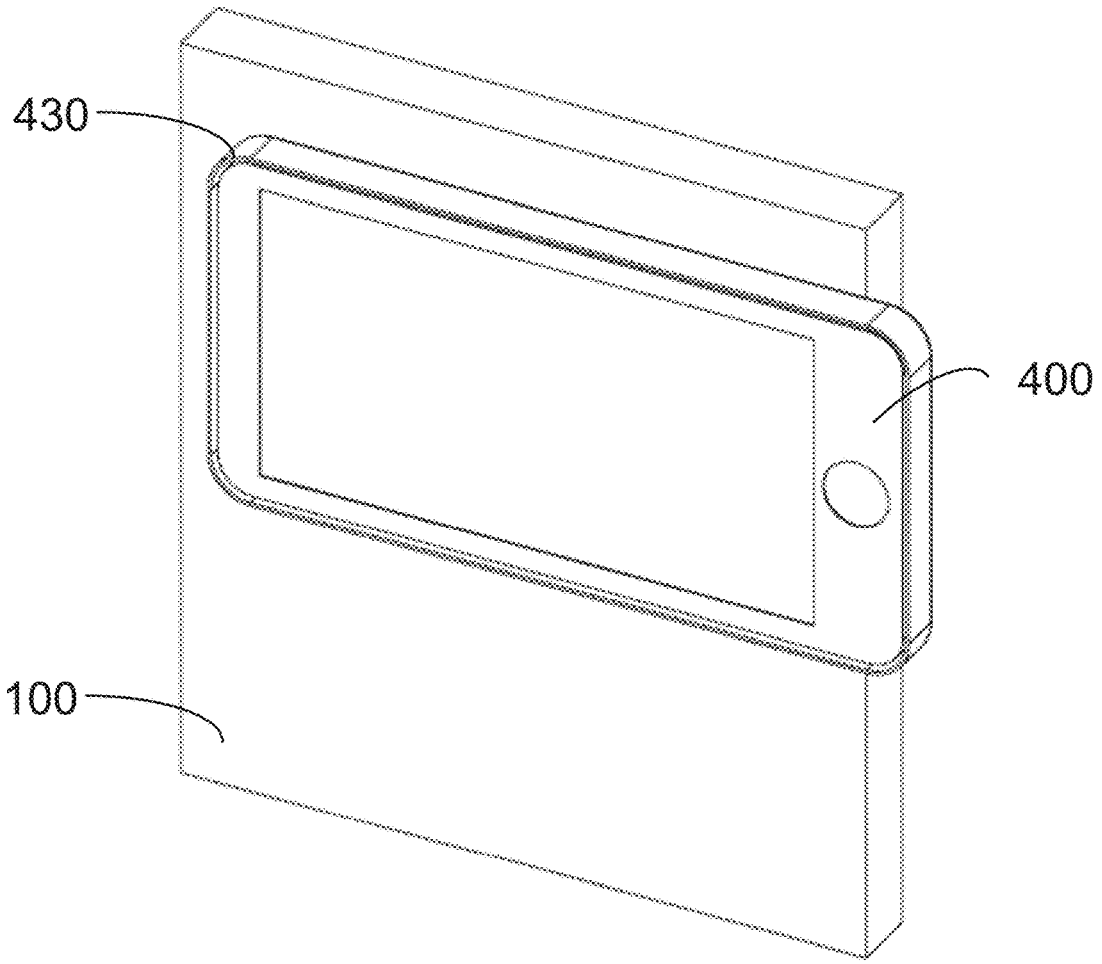
FIG. 3F is a prospective view of an electronic display device within a protective case that is mounted to a surface, according to an embodiment.
Figure 3G:
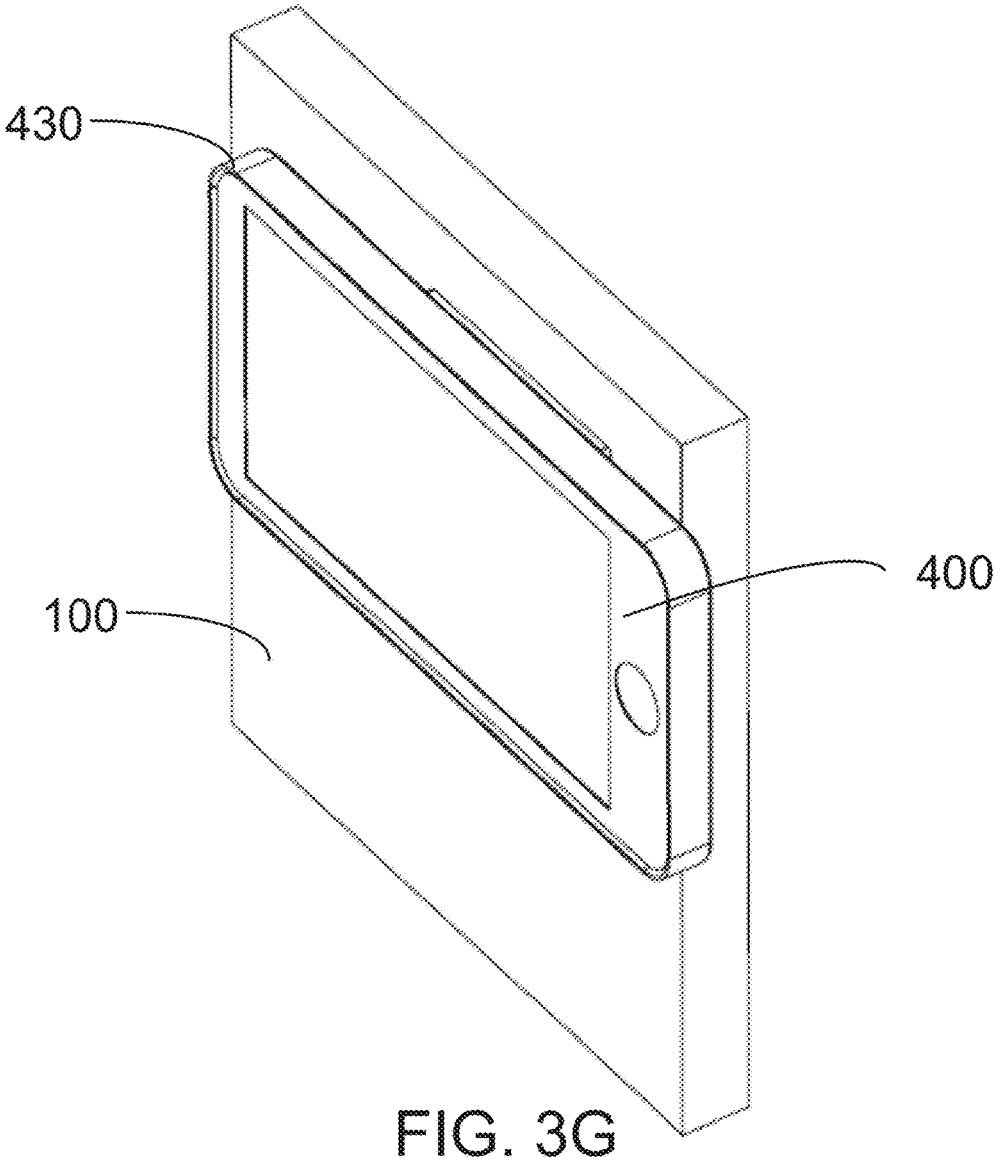
FIG. 3G is another prospective view of an electronic display device within a protective case that is mounted to a surface, according to an embodiment.

FIGS. 3E to 3F show multiple views of an embodiment of an electronic display device 400 mounted in a landscape orientation. FIG. 3E is a front view of electronic display device 400 within a protective case 430 that is mounted to a surface 100. FIG. 3F is a prospective view of electronic display device 400 within a protective case 430 that is mounted to a surface 100. FIG. 3G is another prospective view of electronic display device 400 within a protective case 430 that is mounted to a surface 100. The mounting system described herein can provide a temporary method of attaching an electronic display device to a surface while providing a low profile. In other words, when mounted to the surface, the mounting system does not add significant thickness to the electronic display device. The device-side attachment 410 can be coupled in such a way that it does not add significant thickness to the electronic display device 400 (see, e.g., FIGS. 3B and 3G). The surface-side attachment 110 can be affixed in such a way that it is integrated with the styling and design of surface 100. Surface-side attachment 110 can be colored to match the surface 100 and/or mimic the features already present on surface 100. For example, surface-side attachment 110 can have a brushed aluminum finish and include magnets 200 that resemble buttons on the dash of a vehicle.

An electronic display device 400 can include a device-side attachment 410 coupled to a back side of the electronic display device 400 without using a protective case 430 (not shown). In some embodiments, the magnets 500 can be coupled to the electronic display device 400 with, for example, a double-sided adhesive tape. Other attachment methods such as glues, mechanical latches, hinges, or elastic grip can alternatively be used. The device-side attachment 410 can be used to mount the electronic display device 400 to a surface 100 by coupling with a surface-side attachment 110. The electronic display device 400 can be, for example, a tablet computer, a smartphone, a television, or an LCD display. In some embodiments, the electronic display device 400 can be an Apple iPad or iPhone, an Android smartphone, or eBook reader.

In some embodiments, the device-side attachment has a thickness from about 0.5 to about 6.5 mm, from about 0.5 to about 4 mm, from about 0.5 to about 2 mm, from about 0.5 to about 1.5 mm, or from about 1 to about 2 mm, and including all subranges therebetween each of the ranges. In some embodiments, the device-side attachment has a thickness of about 0.5 mm, about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, or about 6.5 mm. In some embodiments, the device-side attachment has a thickness of less than 0.5 mm, less than 1.0 mm, less than 1.5 mm, less than 2.0 mm, less than 2.5 mm, less than 3.0 mm, less than 3.5 mm, less than 4.0 mm, less than 4.5 mm, less than 5.0 mm, less than 5.5 mm, less than 6.0 mm, or less than 6.5 mm.

In some embodiments, the device-side attachment including the protective cover has a thickness from about 0.5 to about 6.5 mm, from about 0.5 to about 4 mm, from about 0.5 to about 2 mm, from about 0.5 to about 1.5 mm, or from about 1 to about 2 mm, and including all subranges therebetween each of the ranges. In some embodiments, the device-side attachment including the protective cover has a thickness of about 0.5 mm, about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, or about 6.5 mm. In some embodiments, the device-side attachment including the protective cover has a thickness of less than 0.5 mm, less than 1.0 mm, less than 1.5 mm, less than 2.0 mm, less than 2.5 mm, less than 3.0 mm, less than 3.5 mm, less than 4.0 mm, less than 4.5 mm, less than 5.0 mm, less than 5.5 mm, less than 6.0 mm, or less than 6.5 mm.

The magnets 500 of the device-side attachment 410 are attracted to the magnets 200 of the surface-side attachment 110. When the device-side attachment 410 is placed in close proximity to the surface-side attachment 110, the magnetic attractive forces draw the attachments together to mount electronic display device 400. The magnetic attractive forces between magnets 500 and magnets 200 are great enough to overcome the force of gravity on the electronic display device 400 within the protective case 430 when mounted to the surface-side attachment 110. This force of friction between magnets 500 and magnets 200 can be proportional to the normal force and friction coefficient of the materials. The normal force is the magnetic attractive pull force between the magnets 500 and magnets 200. This normal force, in addition to the friction coefficient between the faces of the magnets, produce an overall force of friction high enough to hold the electronic display device 400 in place when mounted to the surface 100.

Magnets 200 and magnets 500 are preferably made out of rare earth metals including alloys of neodymium or samarium-cobalt. Rare earth magnets are selected based on their strongly magnetic properties that include a higher maximum energy product (related to magnetic flux per unit volume) than other types of magnets including ferrite and alnico magnets. Neodymium magnets of grade N48 and higher are preferred, and neodymium magnets of grade N52 and higher are more preferred.

The magnets 200 and the magnets 500 are permanent magnets that retain their magnetic properties once magnetized. Every magnet has a south pole and a north pole axially situated across opposite faces of the magnet. The north pole of a first magnet is attracted to the south pole of a second magnet, and vice versa. The north pole of a first magnet is repulsed by the north pole of a second magnet, and vice versa. The device-side attachment 410 and the surface-side attachment 110 each include at least one magnet with an outwardly-facing north pole, and at least one magnet with an outwardly-facing south pole.

Magnets can generally be uniform or different in shape, size, magnetic and/or other properties within the device-side attachment 410 or within the surface-side attachment 110. While the device-side attachment 410 and the surface-side attachment 110 can be somewhat different in shape, size, magnetic and/or other properties, it is preferred that when mounted, each magnet 500 in device-side attachment 410 is uniform in shape, size, magnetic and/or other properties to its complementary magnet 200 in surface-side attachment 110. However, the magnets 500 of the device-side attachment 410 can be smaller than the magnets 200 of the surface-side attachment 110. It is also preferred that the relative positions (centerlines) of each magnet 500 within a device-side attachment 410 are the same as the relative positions of each complementary magnet 200 within the surface-side attachment 110 when the attachments are coupled during mounting.

The magnets 500 and the magnets 200 within the device-side attachment 410 and the surface-side attachment 110 are arranged to be self-aligning during mounting. The magnets 500 and the magnets 200 are arranged so that when the attachments are coupled together during mounting, at least one magnet with an outwardly-facing north pole of the device-side attachment 410 is attracted to a corresponding magnet with an outwardly-facing south pole of the surface-side attachment 110, and vice versa. If during mounting the magnet with an outwardly-facing north pole of the device-side attachment 410 lines up with a magnet with an outwardly-facing north pole of the surface-side attachment 110, the like poles repulse each other. If during mounting the magnet with an outwardly-facing north pole of the device-side attachment 410 lines up with a magnet with an outwardly-facing south pole of the surface-side attachment 110, the opposite poles attract each other. The magnetic forces of attraction and repulsion, along with the predetermined arrangement of the outwardly-facing poles of the magnets within each attachment, provide for self-alignment of the coupled attachments.

FIGS. 4A to 4I depict examples of self-aligning arrangements of outwardly-facing magnet poles for use in device-side attachments 410 and in surface-side attachments 110. For each magnet having an outwardly-facing north pole "N" on a given attachment, the complementary attachment will have a magnet with outwardly-facing south pole "S" positioned to align when the attachments are coupled. FIGS. 4A, 4F, and 4H are examples of symmetrical self-aligning magnet pole arrangements whereby the electronic display device can be mounted in either of two positions that are 180 degrees of each other. FIGS. 4B to 4E, 4G and 4I are examples of asymmetrical self-aligning magnet pole arrangements whereby the electronic display device can be mounted in only one position.

FIGS. 4J to 4L depict examples of self-aligning arrangements of magnets for device-side attachments 410 and for surface-side attachments 110 including ferrous inserts "Fe". Ferrous inserts can be used in device-side attachments 410 in situations when the positioning of a magnet 500 would interfere with the operation of the electronic display device 400. For example, positioning a magnet over the location of an internal antenna of an electronic display device may interfere with the reception. By placing a ferrous insert within the device-side attachment 410, problems associated with reception can be avoided while allowing the magnets 200 of the surface-side attachment 110 a ferrous surface to attractively couple to.

Ferrous inserts can also be used in surface-side attachments 110 to reduce product costs. Rare earth magnets 200 tend to be expensive. A surface-side attachment 110 that includes at least one magnet with an outwardly-facing north pole and at least one magnet with an outwardly-facing south pole can still provide for self-alignment, while other magnets 200 in the surface-side attachment 110 can be replaced with ferrous inserts that allow the magnets 500 in the device-side attachment 410 a ferrous surface to attractively couple to. The device-side attachment 410 within the mounting system still retains all of the magnets 500 and the ability to attractively couple to any ferrous surface. By incorporating the ferrous inserts into the surface-side attachment 110, the overall cost of the mounting system can be reduced while affording the same level of functionality.

Figure 5:
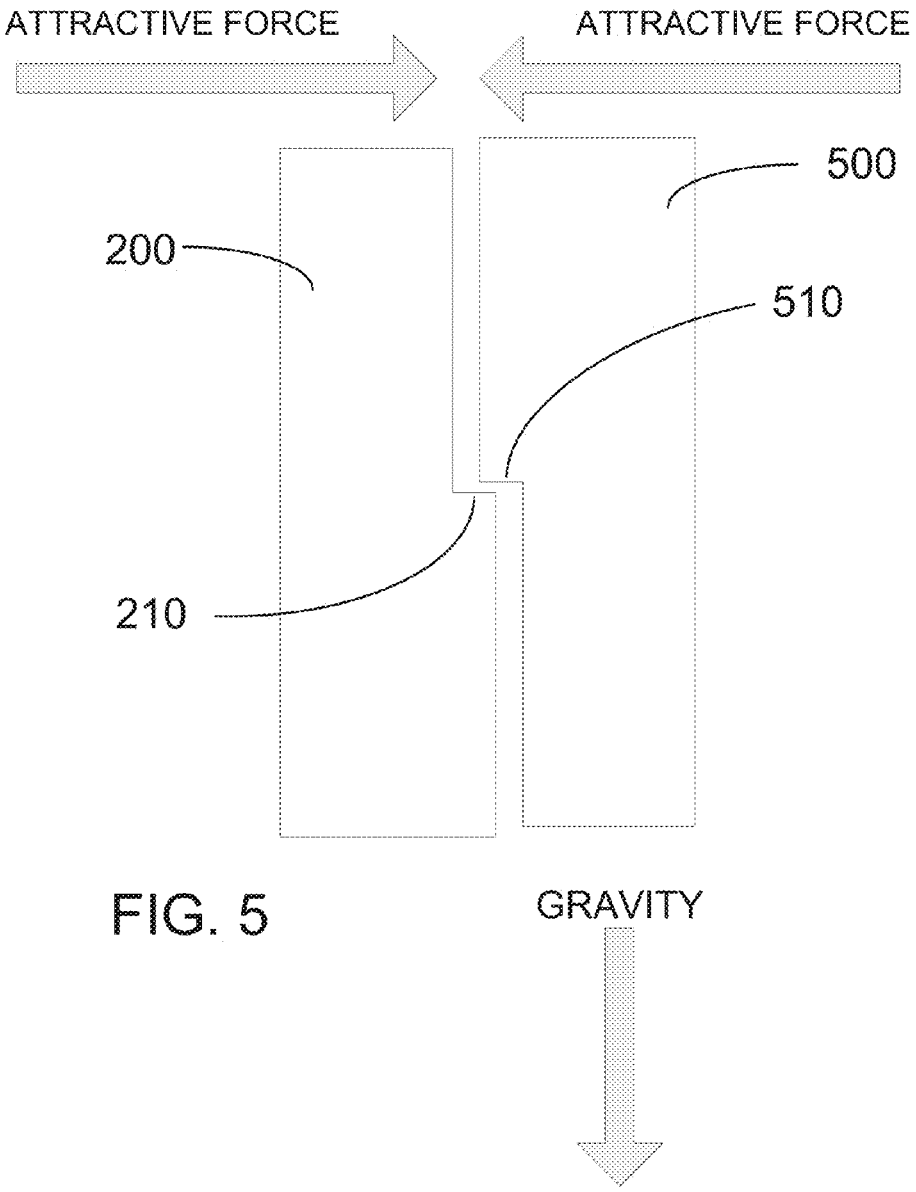
FIG. 5 is a profile view of magnets with mechanical anti-slip features, according to an embodiment.

FIG. 5 is a profile view of magnet 200 with mechanical anti-slip feature 210 coupling to magnet 500 with mechanical anti-slip feature 510. Magnet 200 is included in surface-side attachment 110, and can have an anti-slip feature 210 which interferes with anti-slip feature 510 of magnet 500. Anti-slip feature 210 can be a small protrusion on the outward face of magnet 200 which supports the weight of a mounted electronic display device 400 and resists the force of gravity upon the mounted electronic display device 400. Anti-slip feature 210 and anti-slip feature 510 are complementary to each other in that they can interlock or mate with each other when magnet 200 couples with magnet 500. When interlocked or mated together, the complementary mechanical anti-slip feature 210 and mechanical anti-slip feature 510 form a boundary with substantially no gaps or spaces between magnet 200 and magnet 500. Because anti-slip feature 210 interferes with anti-slip feature 510 to resist the force of gravity, the attractive forces between magnet 200 and magnet 500 can be fully applied to coupling the electronic display device 400 to the surface 100. By incorporating a mechanical anti-slip feature in the outward faces of the magnets, the size and number of the magnets can be reduced thus reducing the bulk and weight of the mounting system. This is because the attractive forces needed to generate a normal friction force to resist the force of gravity is lesser since the coupled anti-slip features 210 and 510 support the weight of the mounted electronic display device 400. Alternatively, when mechanical anti-slip features are employed, lower grade magnets with weaker attractive forces, which are usually less expensive, can be used to provide the necessary attractive forces to couple the attachments when the electronic display device 400 is mounted.

In some embodiments, the mechanical anti-slip feature 210 and mechanical anti-slip feature 510 are incorporated within magnet 200 and magnet 500, respectively. In some embodiments, the mechanical anti-slip feature 210 and mechanical anti-slip feature 510 are incorporated into a thin layer of a material that can be easily shaped or easily milled. The thin layer of material is permanently adhered to magnet 200 and magnet 500. The thin layer of material can be made of metal, polymer, or other suitable materials. FIG. 6 is a profile view of magnet 200 with mechanical anti-slip feature 220 coupling to magnet 500 with mechanical anti-slip feature 520. Anti-slip feature 220 can cover the entire outward face of magnet 200 and includes a continuous low profile set of protrusions and recesses, for example, in a saw tooth pattern or zig-zag pattern. A low profile continuous pattern can afford a high degree interference between anti-slip feature 220 and complementary anti-slip feature 520, and at the same time not interact with non-patterned, non-complementary surfaces. For example, an electronic display device 400 within a protective cover 430 that includes a device-side attachment 410 containing magnets 500 with anti-slip feature 520 can be easily inserted into and removed from a pocket of a user without snagging the fabric, yet still provides a high degree of resistance to gravity when mounted to surface-side attachment 110 that include a complementary anti-slip feature 220.

Figure 7:
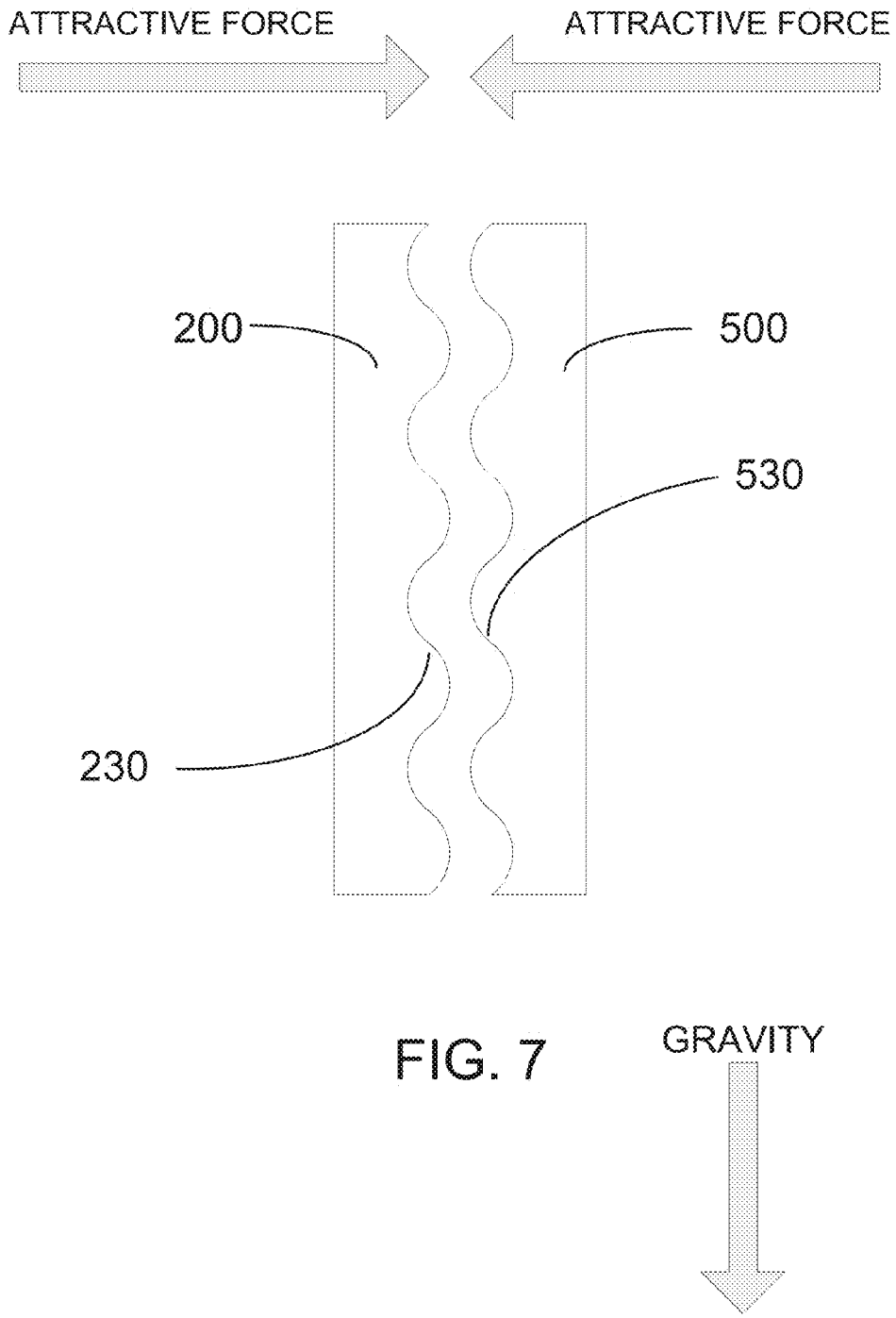
FIG. 7 is a profile view of magnets with mechanical anti-slip features, according to another embodiment.

FIG. 7 is a profile view of magnet 200 with mechanical anti-slip feature 230 coupling to magnet 500 with a complementary mechanical anti-slip feature 530. In this embodiment, anti-slip feature 230 is a continuous sinusoidal wave pattern that interferes with a complementary anti-slip feature 530 of magnet 500. The continuous sinusoidal wave pattern design of anti-slip features 230 and 530 is easily cleaned and provides some resistance to gravity when coupled, though the resistance is lesser than the amounts provided by the designs in FIGS. 5 and 6.

Figure 8:
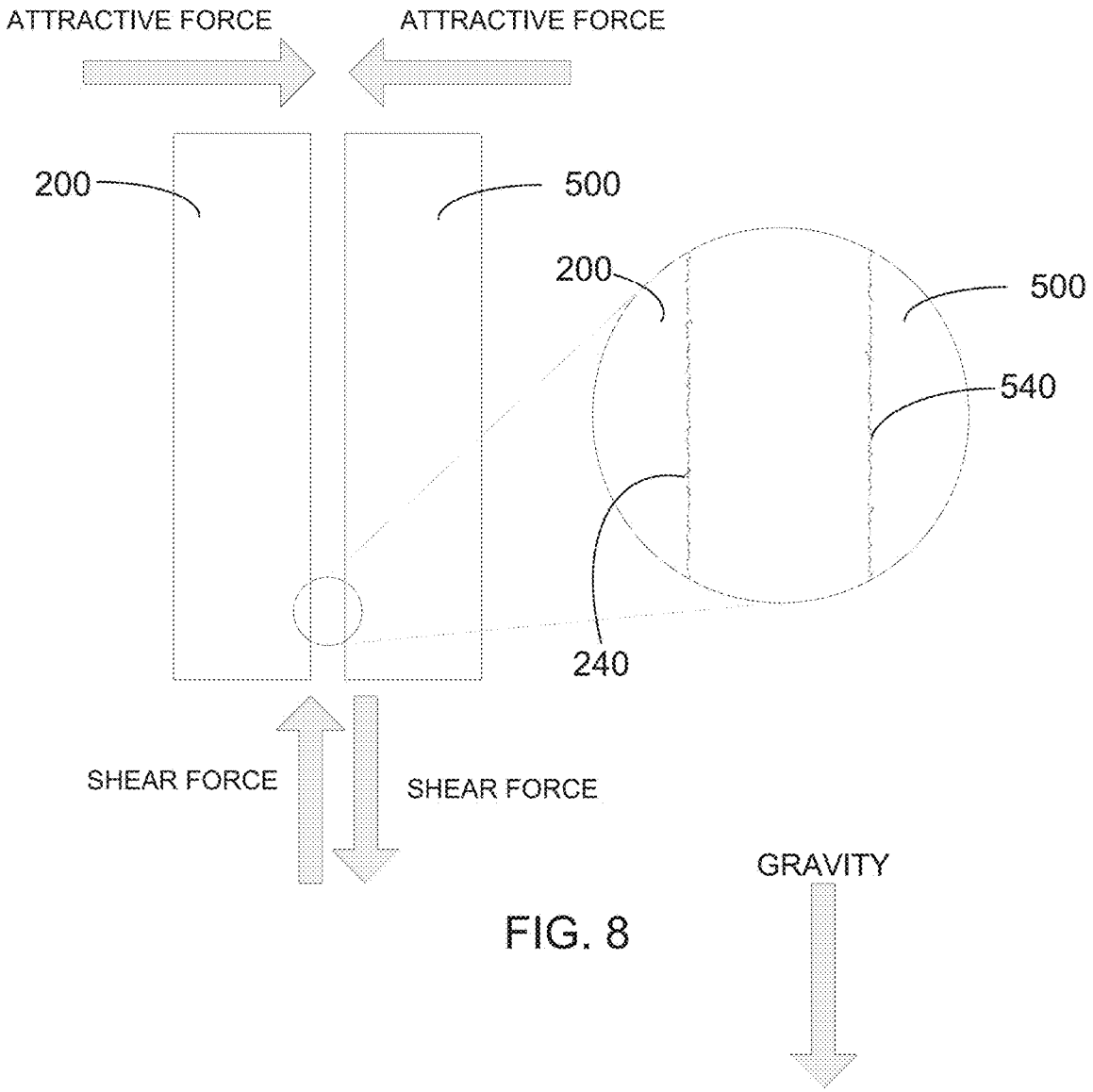
FIG. 8 is a profile view of magnets with anti-slip faces, according to an embodiment.

FIG. 8 is a profile view of magnet 200 with anti-slip face 240 coupling to magnet 500 with an anti-slip face 540. As shown in the inset, anti-slip face 240 and anti-slip face 540 are substantially parallel with a roughened outward face that increases the coefficient of friction between the coupled faces. It has been found that anti-slip faces with an average root mean square surface roughness ("RMS") of between 100 and 300 microns are particularly suitable by providing sufficient resistance to the shear force created by gravity, yet not being so rough as to interfere with normal operations of the electronic display device. The direction of the shear force can be substantially parallel to the anti-slip faces of the magnets and perpendicular to the attractive force between the magnets when the anti-slip faces are mounted in a vertical position.

While each the foregoing embodiments of mechanical anti-slip features and anti-slip faces are depicted as part of a magnet, the anti-slip features and anti-slip faces can also be incorporated into a separate piece of material that is coupled to the outward faces of the magnets. For example, when device-side attachment 410 is embedded in protective cover 430, magnets 500 can be covered with a thin layer of silicon rubber material that is also used to construct the protective cover 430. The thin layer of silicon rubber covering the outward faces of magnets 500 can also be molded into shapes with anti-slip features and/or anti-flip faces.

It can be advantageous to incorporate mechanical anti-slip features and anti-slip faces into a separate piece of material that is coupled to the outward faces of the magnets. Rare earth magnets are brittle and easily chipped. A separate piece of material coupled to the outward faces of the magnets can protect the magnets from damage. Also, the brittleness and corrosive properties of rare earth magnets make them difficult to machine. By attaching a separate piece of material to the outward faces of the magnets, any machining or molding during manufacture of the magnets can be avoided thus reducing manufacturing costs.

Any material disposed between a device-side attachment 410 mounted to a surface-side attachment 110 can be selected based on its magnetic permeability. A material with high magnetic permeability can allow the magnets 200 and magnets 500 to tightly couple when the electronic display device is mounted.

Figure 9A:
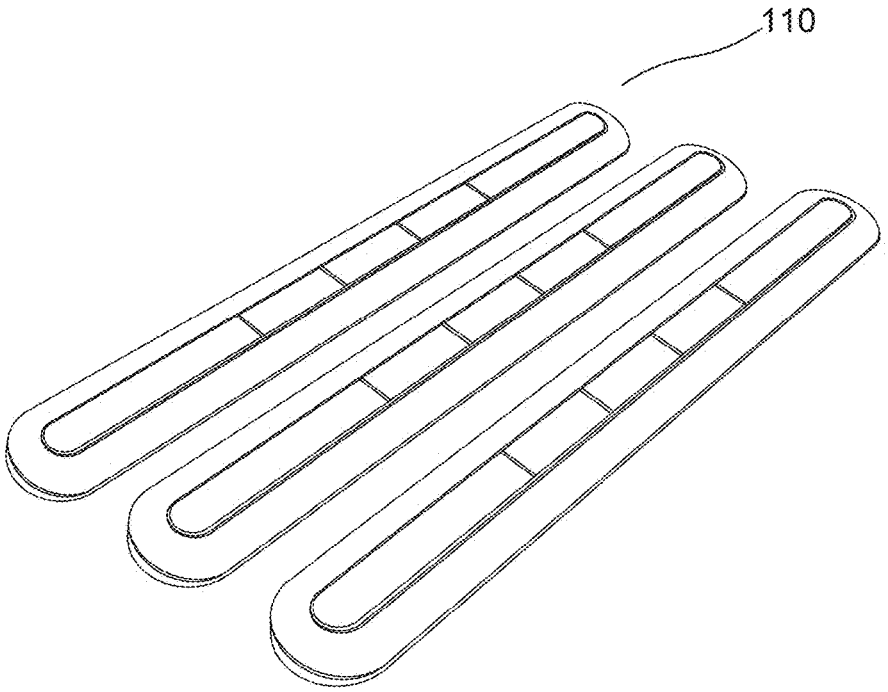
FIG. 9A is a prospective view of three surface-side attachments, according to an embodiment.

FIG. 9A is a prospective view of three surface-side attachments 110. In this example, the plurality of magnets is permanently affixed to an aluminium housing.

Figure 9B:
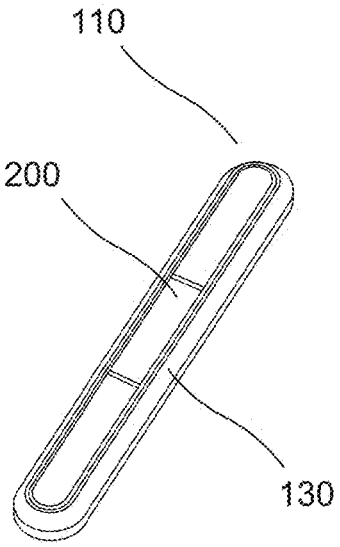
FIG. 9B is a prospective view of a surface-side attachment including three magnets within a surface-side attachment housing, according to an embodiment.

FIG. 9B is a prospective view of a surface-side attachment 110 including three magnets 200 within a surface-side attachment housing 130. In this example, the plurality of magnets is permanently affixed to an aluminium housing.

Figure 9C:
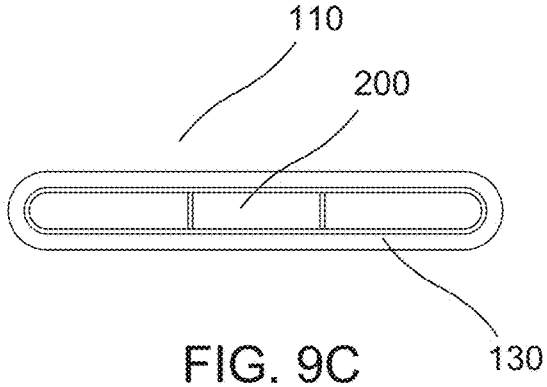
FIG. 9C is a front view of a surface-side attachment including three magnets within a surface-side attachment housing, according to an embodiment.

FIG. 9C is a front view of a surface-side attachment 110 including three magnets 200 within a surface-side attachment housing 130. In this example, the plurality of magnets is permanently affixed to an aluminium housing.

Figure 10:
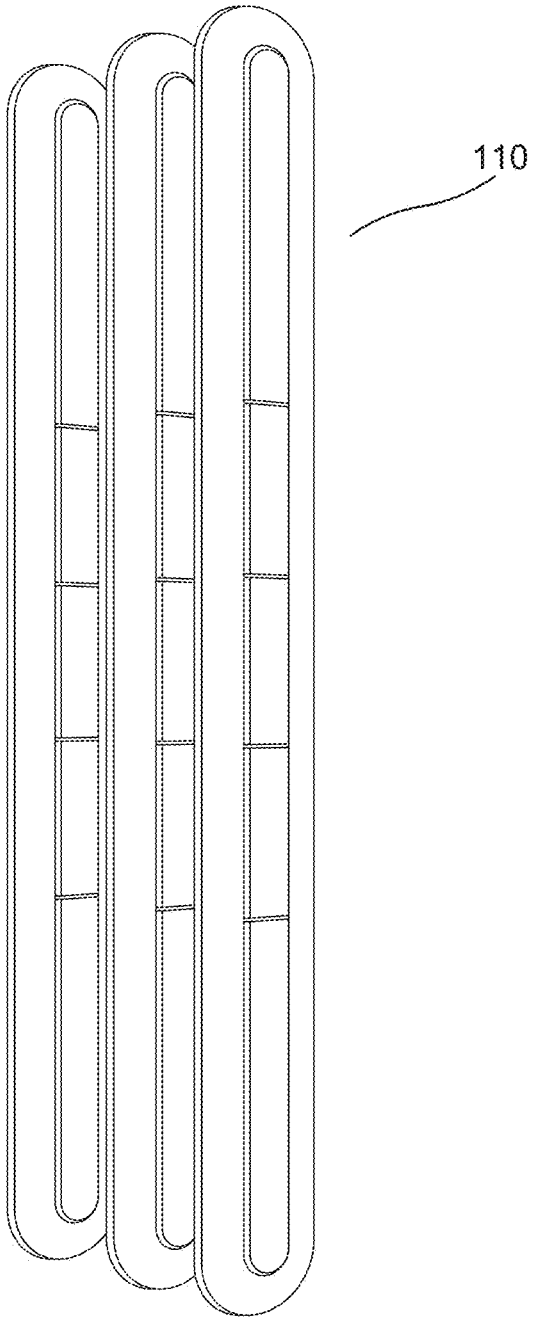
FIG. 10 is a prospective view of three surface-side attachments, according to an embodiment.

FIG. 10 is a prospective view of three surface-side attachments 110.

In some embodiments, the surface-side attachment has a thickness from about 0.5 to about 6.5 mm, from about 0.5 to about 4 mm, from about 0.5 to about 2 mm, from about 0.5 to about 1.5 mm, or from about 1 to about 2 mm, and including all subranges therebetween each of the ranges. In some embodiments, the surface-side attachment has a thickness of about 0.5 mm, about 1.0 mm, about 1.5 mm, about 2.0 mm, about 2.5 mm, about 3.0 mm, about 3.5 mm, about 4.0 mm, about 4.5 mm, about 5.0 mm, about 5.5 mm, about 6.0 mm, or about 6.5 mm. In some embodiments, the surface-side attachment has a thickness of less than 0.5 mm, less than 1.0 mm, less than 1.5 mm, less than 2.0 mm, less than 2.5 mm, less than 3.0 mm, less than 3.5 mm, less than 4.0 mm, less than 4.5 mm, less than 5.0 mm, less than 5.5 mm, less than 6.0 mm, or less than 6.5 mm.

Figure 11:
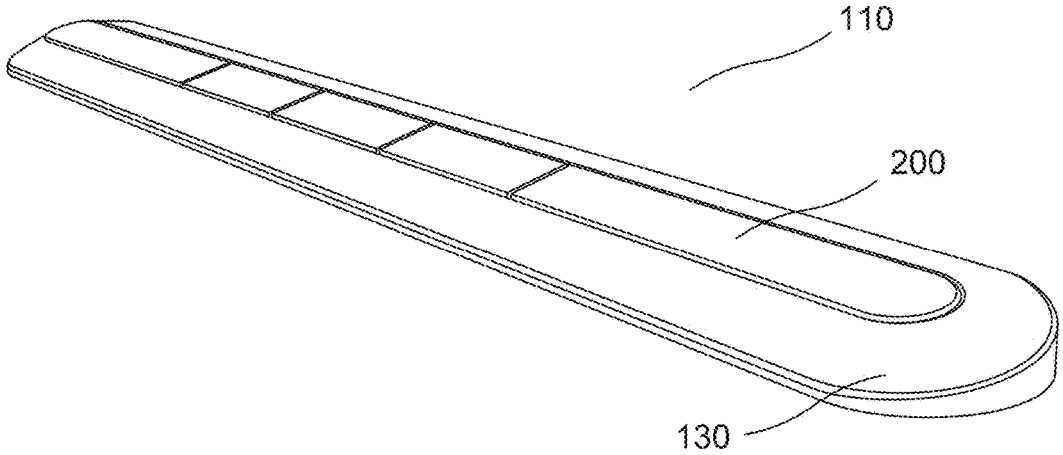
FIG. 11 is a prospective view of a surface-side attachment including five magnets and a surface-side attachment housing further including an angled face, according to an embodiment.

FIG. 11 is a prospective view of a surface-side attachment 110 including five magents 200 and a surface-side attachment housing 130 further including an angled face. The angled face of surface-side attachment 110 can provide increased coupling strength by the angled face supporting a portion of the weight of the electronic display device 400. The angled face can also improve the coupling strength of the mounting system by positioning the lower end of the electronic display device 400 against the surface 100 which reduces the tendency of the electronic display device 400 to rotate about the bottom edge of surface-side attachment 110 and separate from the top edge of surface-side attachment 110.

Figure 12:
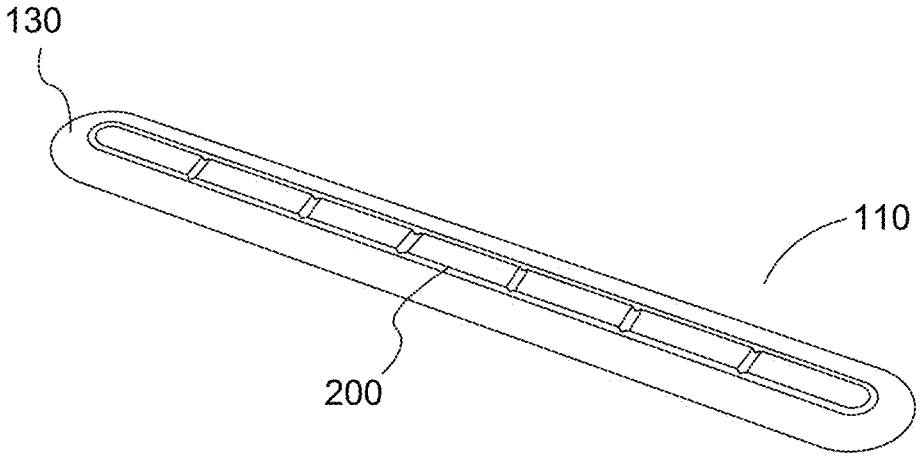
FIG. 12 is a prospective view of a surface-side attachment including seven magnets within a surface-side attachment housing, according to an embodiment.

FIG. 12 is a prospective view of a surface-side attachment 110 including seven magnets 200 within a surface-side attachment housing 130.

Figure 13:
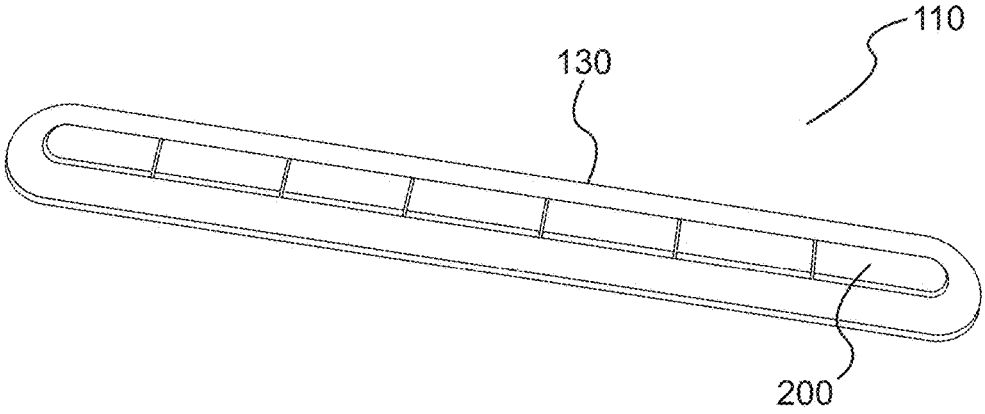
FIG. 13 is a prospective view of a surface-side attachment including seven magnets within a surface-side attachment housing, according to an embodiment.

FIG. 13 is a prospective view of a surface-side attachment 110 including seven magnets 200 within a surface-side attachment housing 130.

Figure 14:
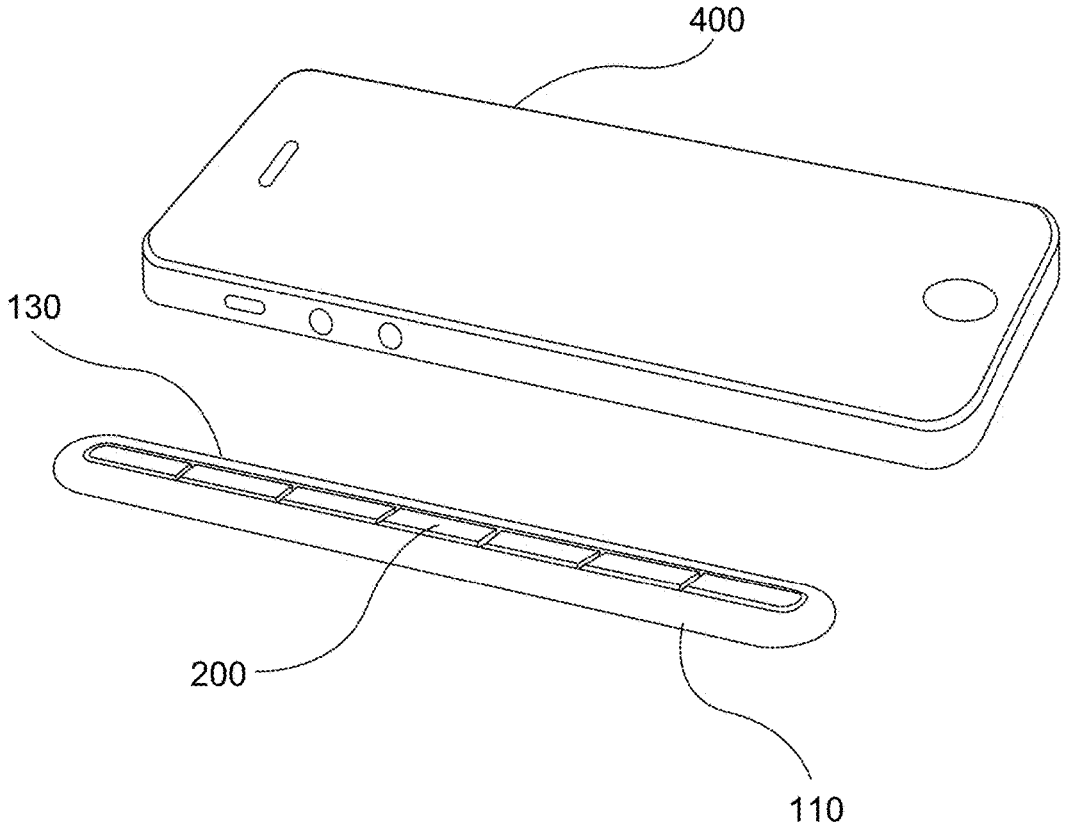
FIG. 14 is a prospective view of a surface-side attachment including seven magnets within a surface-side attachment housing next to an electronic display device, according to an embodiment.

FIG. 14 is a prospective view of a surface-side attachment 110 including seven magnets 200 within a surface-side attachment housing 130 next to an electronic display device 400.

Figure 15A:
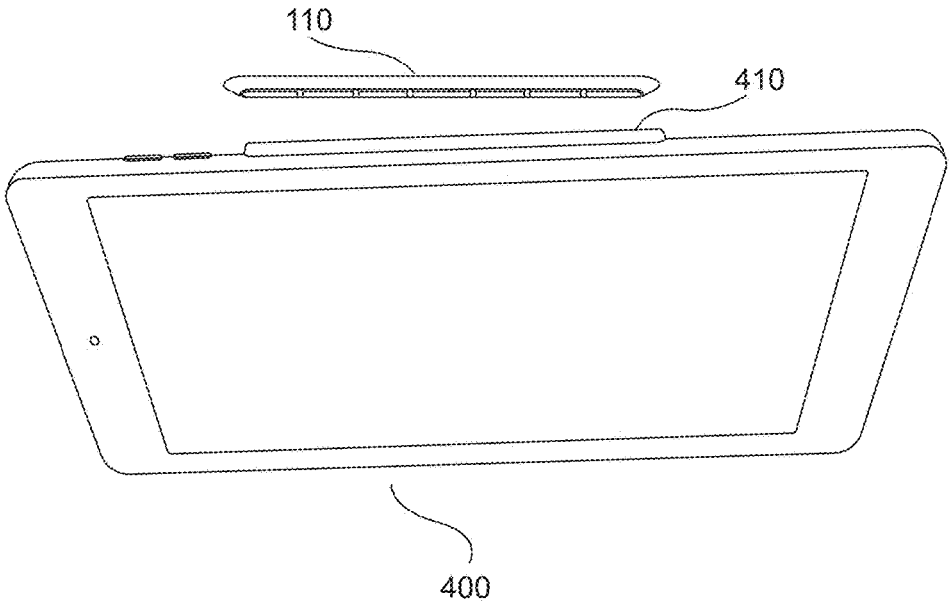
FIG. 15A is a prospective view of an electronic display device including device-side attachment being mounted to a surface-side attachment, according to an embodiment.

FIG. 15A is a prospective view of an electronic display device 400 including device-side attachment 410 being mounted to a surface-side attachment 110.

Figure 15B:
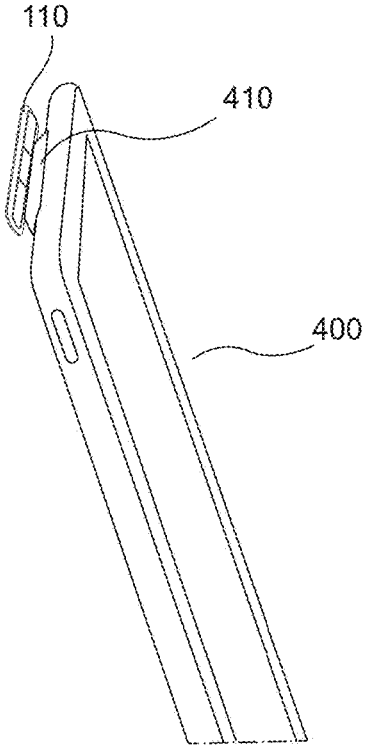
FIG. 15B is a profile view of an electronic display device including device-side attachment mounted to a surface-side attachment, according to an embodiment.

FIG. 15B is a profile view of an electronic display device 400 including device-side attachment 410 mounted to a surface-side attachment 110.

Figure 16:
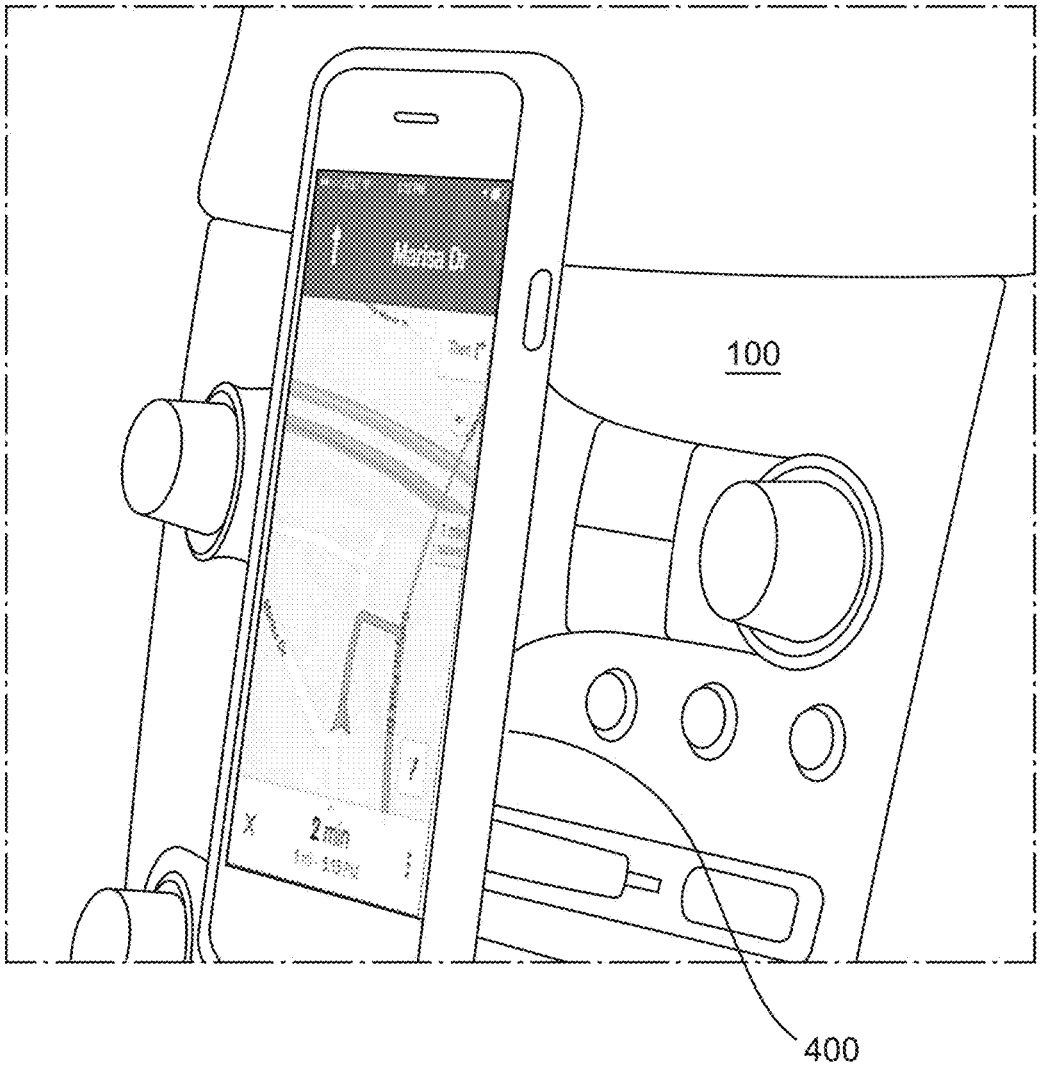
FIG. 16 is a prospective view of an electronic display device mounted to vehicle dash surface.

FIG. 16 is a prospective view of an electronic display device 400 mounted to vehicle dash surface 100.

FIG. 17 are partial front views of a surface-side attachment 110 affixed to various surfaces 100 including wood, fabric, glass, painted wall, leather and aluminum.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

Where schematics and/or embodiments described above indicate certain components arranged in certain orientations or positions, the arrangement of components may be modified. While the embodiments have been particularly shown and described, it will be understood that various changes in form and details may be made. Any portion of the apparatus and/or methods described herein may be combined in any combination, except mutually exclusive combinations. The embodiments described herein can include various combinations and/or sub-combinations of the functions, components, and/or features of the different embodiments described.

What is claimed:

1. A mounting system for mounting an electronic display device to a surface, the mounting system comprising:

a device-side attachment including a first plurality and a second plurality of magnets disposed and configured to couple to the electronic display device, the first plurality and the second plurality of magnets each including at least one magnet with an outwardly-facing north pole and at least one magnet with an outwardly-facing south pole; and a surface-side attachment including a third plurality of magnets disposed and configured to couple to the surface, the third plurality of magnets including at least one magnet with an outwardly-facing north pole and at least one magnet with an outwardly-facing south pole, wherein the at least one magnet with an outwardly-facing north pole of the first plurality or the second plurality of magnets is arranged to couple with the at least one magnet with an outwardly-facing south pole of the third plurality of magnets, and the at least one magnet with an outwardly-facing south pole of the first plurality or the second plurality of magnets is arranged to couple with the at least one magnet with an outwardly-facing north pole of the third plurality of magnets, the first plurality of magnets or the second plurality of magnets configured to have an attractive force toward the third plurality of magnets to overcome a gravitational force on the electronic display device, the first plurality and the second plurality of magnets disposed and configured to allow the electronic display device to be hung in either a portrait orientation or a landscape orientation.

2. The mounting system of claim 1, wherein the device-side attachment further comprises a first adhesive to couple the first plurality of magnets to the electronic display device.

3. The mounting system of claim 2, wherein the first adhesive is a pressure sensitive adhesive.

4. The mounting system of claim 1, wherein the surface-side attachment further comprises a second adhesive to couple the surface-side attachment to the surface.

5. The mounting system of claim 4, wherein the second adhesive is a pressure sensitive adhesive.

6. The mounting system of claim 1, wherein the first plurality of magnets, the second plurality of magnets, and the third plurality of magnets are made from rare earth metals.

7. The mounting system of claim 6, wherein the rare earth metals include alloys of neodymium or samarium-cobalt.

8. The mounting system of claim 7, wherein the first plurality of magnets and the second plurality of magnets are grade N48 or higher.

9. The mounting system of claim 8, wherein the first plurality of magnets, the second plurality of magnets, and the third plurality of magnets each comprise two linear rows of magnets, each linear row containing five magnets.

10. The mounting system of claim 1, wherein the surface-side attachment and the device-side attachment are made from one or both of a metal and a polymer.

11. The mounting system of claim 10, wherein the first plurality of magnets is glued to the device-side attachment and the third plurality of magnets is glued to the surface-side attachment.

12. A self-aligning mounting system for mounting an electronic display device to a surface, the self-aligning mounting system comprising:

a device-side attachment including a first plurality and a second plurality of magnets disposed in a protective cover for the electronic display device, the first plurality and the second plurality of magnets each including at least one magnet with an outwardly-facing north pole and at least one magnet with an outwardly-facing south pole, the first plurality and the second plurality of magnets disposed in different locations along a perimeter of the protective cover; and a surface-side attachment including a third plurality of magnets disposed in a housing and configured to attach to the surface, the third plurality of magnets including at least one magnet with an outwardly-facing north pole and at least one magnet with an outwardly-facing south pole, wherein the at least one outwardly-facing north pole of the first plurality and second plurality of magnets is arranged to attractively couple with the at least one outwardly-facing south pole of the third plurality of magnets, the at least one outwardly-facing south pole of the first plurality or the second plurality of magnets is arranged to couple with the at least one outwardly-facing north pole of the third plurality of magnets, such that when the first plurality of magnets is coupled to the third plurality of magnets, the second plurality of magnets remains uncoupled, and when the second plurality of magnets is coupled to the third plurality of magnets, the first plurality of magnets remains uncoupled, and the high friction surface of the protective cover covering the first plurality and second plurality of magnets is configure to be disposed between the first plurality and second plurality of magnets when coupled to the third plurality of magnets.

13. The self-aligning mounting system of claim 12, wherein the first plurality and the second plurality of magnets are affixed to the interior along a perimeter of the protective cover.

14. The self-aligning mounting system of claim 12, wherein the first plurality and the second plurality of magnets are embedded in along a perimeter of the protective cover.

15. The self-aligning mounting system of claim 12, wherein the surface-side attachment further comprises an adhesive to couple the surface-side attachment to the surface.

16. The self-aligning mounting system of claim 12, wherein the adhesive is a pressure sensitive adhesive.

17. The self-aligning mounting system of claim 12, wherein the first plurality, the second plurality of magnets, and the third plurality of magnets are made from rare earth metals.

18. The self-aligning mounting system of claim 17, wherein the rare earth metals including alloys of neodymium or samarium-cobalt.

19. A mounting system for mounting an electronic display device to a surface, the mounting mechanism system comprising:

a device-side attachment including a first outward face and a first plurality of magnets disposed and configured to couple to the electronic display device, a second outward face and a second plurality of magnets disposed and configured to couple to the electronic display device, the first plurality and the second plurality of magnets each including at least one magnet with an outwardly-facing north pole and at least one magnet with an outwardly-facing south pole, the first outward face and a second outward face each including at least one recess and/or at least one protrusion, and a surface-side attachment including third outward face and a third plurality of magnets disposed and configured to attach to the surface, the third plurality of magnets including at least one magnet with an outwardly-facing north pole and at least one magnet with an outwardly-facing south pole, the third outward face including at least one recess and/or at least one protrusion, wherein the at least one outwardly-facing north pole of the first plurality and the second plurality of magnets is arranged to attractively couple with the at least one outwardly-facing south pole of the third plurality of magnets, the at least one outwardly-facing south pole of the first plurality and the second plurality of magnets is arranged to attractively couple with the at least one outwardly-facing north pole of the third plurality of magnets such that when the first plurality of magnets is coupled to the third plurality of magnets, the second plurality of magnets remains uncoupled, and when the second plurality of magnets is coupled to the third plurality of magnets, the first plurality of magnets remains uncoupled, and the first outward face or the second outward face of the device-side attachment is configured to mechanically interfere with the third outward face of the surface-side attachment to inhibit a shear force.

* * * * *